US006136484A

United States Patent [19]

Katayama et al.

[11] Patent Number: 6,136,484

[45] Date of Patent: Oct. 24, 2000

[54] ELECTROPHOTOGRAPHIC PHOTORECEPTOR, PROCESS FOR PRODUCTION THEREOF, AND IMAGE-FORMING APPARATUS USING SAME

[75] Inventors: Satoshi Katayama, Nabari; Yoshihide Shimoda, Nara; Makoto Kurokawa, Tenri; Mikio Kakui, Nara; Hiroko Ishibashi, Nara; Tadashi Nakamura, Nara; Tatsuhiro Morita, Kashiba; Masayuki Sakamoto, Nabari; Kazushige Morita, Nara; Tomoko Kanazawa, Kashihara; Akihiko Kawahara, Nara, all of Japan

[73] Assignee: Sharp Kabushiki Kaisha, Osaka, Japan

[21] Appl. No.: 09/322,926

[22] Filed: Jun. 1, 1999

[30] Foreign Application Priority Data

May 29, 1998 [JP] Japan ..... 10-150450

[51] Int. Cl.[7] ..... G03G 5/14

[52] U.S. Cl. ..... 430/63; 430/131

[58] Field of Search ..... 430/65, 66, 131, 430/62, 63

[56] References Cited

U.S. PATENT DOCUMENTS

| | | | |
|---|---|---|---|
| 4,518,669 | 5/1985 | Yashiki | 430/57 |
| 4,579,801 | 4/1986 | Yashiki | 430/60 |
| 5,391,448 | 2/1995 | Katayama et al. | 430/65 |
| 5,958,638 | 9/1999 | Katayama et al. | 430/65 |

FOREIGN PATENT DOCUMENTS

| | | |
|---|---|---|
| 0 649 816 A1 | 4/1995 | European Pat. Off. . |
| 0 696 763 A1 | 2/1996 | European Pat. Off. . |
| 0 718 699 A2 | 6/1996 | European Pat. Off. . |
| 34 28 407 A1 | 2/1985 | Germany . |
| 48-47344 | 7/1973 | Japan . |
| 56-52757 | 5/1981 | Japan . |
| 59-84257 | 5/1984 | Japan . |
| 4-172362 | 6/1992 | Japan . |

OTHER PUBLICATIONS 7.7 azeotropes, Chemical Handbook, Basic 2, Maruzen Co., Ltd., © the Chemical Society of Japan, p. 751, Jun. 20, 1975.

*Primary Examiner*—John Goodrow
*Attorney, Agent, or Firm*—Nixon & Vanderhye

[57] ABSTRACT

Highly sensitive and highly durable electrophotographic photoreceptors which generate faultless images can be produced by forming the under-coating layer on the conductive support and forming the photoreceptive layer on the layer. The under-coating layer contains dendritic titanium oxide. The under-coating layer contains the dendritic titanium oxide of which the surface is coated with (a) metal oxide(s) and/or (an) organic compound(s). The photoreceptive layer contains a phthalocyanine pigment, and the under-coating layer contains dendritic or needle-like titanium oxide of which the surface is coated with (a) metal oxide(s) and/or (an) organic compound(s). The photoreceptive layer contains a phthalocyanine pigment, and the under-coating layer contains dendritic or needle-like titanium oxide, of which the surface is coated with (a) metal oxide(s) and/or (an) organic compound(s), and an alcohol soluble polyamide resin.

16 Claims, 2 Drawing Sheets a : MAJOR AXIS
b : MINOR AXIS

ELECTROPHOTOGRAPHIC PHOTORECEPTOR, PROCESS FOR PRODUCTION THEREOF, AND IMAGE-FORMING APPARATUS USING SAME

BACKGROUND OF THE INVENTION

1. Field of the Invention

The present invention relates to an electrophotographic photoreceptor comprising an under-coating layer for use in digital apparatuses, a process for producing the same, and an image-forming apparatus using the same.

2. Description of the Related Art

In general, a process for electrophotography using a photoreceptor with photoconductivity is one of information recording methods utilizing a photoconductive phenomenon of a photoreceptor. After the surface of the photoreceptor is uniformly charged by corona discharge in a dark place, the charge of an exposed portion is selectively discharged by image exposure to form an electrostatic latent image at a non-exposed portion. After that, colored charged corpuscles (toner) are adhered to the electrostatic latent image to generate an image as a visual picture.

In a sequence of these processes, the followings are required as basic characteristics of the photoreceptor: uniformly chargeable at an appropriate electric potential in a dark place; having a potent charge-holding capacity with little discharge in a dark place; and having high photosensitivity to discharge rapidly by photo-irradiation. In addition, high stability and durability are required such as: easy removability of charge from a surface of a photoreceptor to reduce residual electric potential; high mechanical strength and flexibility; unchangeable electrical characteristics in repeated use, such as electrically charged property, photosensitivity and residual electric potential; and durability against such an environment as heat, light, temperature, humidity and ozone.

In the currently practically used electrophotographic photoreceptor, which is constructed by forming a photoreceptive layer over a conductive support, the electric charges on the surface of a photoreceptor are microscopically lost or reduced to generate a defect of image because a carrier injection is readily caused from the conductive support. In order to prevent it, it is effective to coat defects on the surface of the conductive support, improve electrically charged property of the surface of the conductive support and adhesive property of the photoreceptive layer, and enhance easiness of the application, and therefore an under-coating layer is provided between the conductive support and the photoreceptive layer.

Heretofore, layers comprising a variety of resin materials, metallic particles and metal oxide particles have been examined as the under-coating layer. For example, an under-coating layer containing titanium oxide particles has been examined. The known resin materials used in formation of the under-coating layer of a resin single layer include polyethylene, polypropylene, polystyrene, acrylic resin, vinyl chloride resin, vinyl acetate resin, polyurethane resin, epoxy resin, polyester resin, melamine resin, silicone resin, poly (vinyl butyral) resin, polyamide resin, copolymer resin containing two or more of their repeating units, casein, gelatin, polyvinyl alcohol, and ethylcellulose, and particularly, Japanese Unexamined Patent Publication JP-A 48-47344 (1973) discloses that the polyamide resin is preferred.

The electrophotographic photoreceptor having a single under-coating layer of the polyamide resin, however, shows a tendency to decrease the sensitivity and generate such an image defect as fogging due to large accumulation of the residual electric potential. This tendency is particularly remarkable under circumstances of low temperatures and low humidities. In this connection, JP-A 56-52757 proposes to provide an under-coating layer containing surface-untreated titanium oxide particles in order to prevent an image defect caused by the conductive support and reduce the residual electric potential. In addition, JP-A 4-172362 proposes to provide an under-coating layer containing metal oxide particles of which the surface has been treated with a titanate-type coupling agent in order to improve dispersibility of the titanium oxide particles. U.S. Pat. No. 5,391,448 discloses a photoreceptor comprising an under-coating layer for use in analog apparatuses, in which photoreceptor a relationship between the percentage by weight of a non-conductive needle-like titanium oxide particles content to the under-coating layer and the thickness of the under-coating layer is defined. Furthermore Japanese Unexamined Patent Publication JP-A 59-84257 (1984) discloses a photoreceptor comprising an under-coating layer in which titanium oxide powder and tin oxide powder are dispersed. The proposals disclosed in these Publications are still insufficient in characteristics, and accordingly an electrophotographic photoreceptor having much better characteristics is desired. In the under-coating layers containing metal oxide particles, granular metal oxide particles are used.

In producing the electrophotographic photoreceptors, particularly, the photoreceptive layer may be formed by means of a variety of application, such as a spray method, bar-coating method, roller-coating method, blade method, ring method or dip coating method. In particular, the dip coating method, which comprises immersing a conductive support into a vessel filled with an applying solution and pulling out the support at a certain rate or a gradually changing rate to form a desired layer, is utilized in many cases since it is relatively simple and superior in productivity and cost.

Thus, when such a much employed dip coating method is used in production of the under-coating layer, the resin contained in the liquid coating material for forming the under-coating layer is desired to be hardly soluble in a solvent for the coating solution for forming the photoreceptive layer; in general, a resin soluble in alcohols or water is used. The liquid coating material for forming the under-coating layer may be prepared as an alcohol solution or suspension using such a resin, and applied onto a support by immersion to form an under-coating layer.

The electrophotographic photoreceptors which are provided with an under-coating layer containing the surface-untreated titanium oxide particles or under-coating layer containing the metal oxide particles of which the surface is treated with a titanate-type coupling agent are still insufficient in characteristics. Accordingly, the electrophotographic photoreceptors that are much better in sensitivity and durability to produce a faultless image are desired.

SUMMARY OF THE INVENTION

An object of the invention is to provide an electrophotographic photoreceptor which is able to generate a highly sensitive and highly durable image with no defect. Another object of the invention is to provide a process for producing such an electrophotographic photoreceptor. Further object of the invention is to provide an image-forming apparatus using such an electrophotographic photoreceptor.

The invention relates to an electrophotographic photoreceptor comprising a conductive support, an under-coating layer provided on the conductive support, and a photosensitive layer provided on the under-coating layer, wherein the under-coating layer contains dendritic titanium oxide.

According to the invention, the dendritic titanium oxide contained in the under-coating layer inhibits to aggregate more effectively than granular titanium oxide. Accordingly, a high dispersibility is attained even in an increased content of titanium oxide in the liquid coating material for forming the under-coating layer, and the photoreceptor containing the under-coating layer produced with such a liquid coating material has lesser defects in the coating. Moreover, the photoreceptor is superior in electrically charged property and small in residual electric potential, as well as, in repeated use, small in accumulation of the residual electric potential and lesser in deterioration of the photosensitivity. Therefore, an electrophotographic photoreceptor satisfactory in stability and environmental characteristics can be obtained.

When metallic particles are contained in the under-coating layer, the electrically charged property is lowered and an image concentration decreases. Moreover, when metal oxide particles, e.g. titanium oxide, are contained in the under-coating layer in a smaller quantity relative to that of an adhesive resin, the volume resistance of the under-coating layer increases, transport of the carrier generated by photo-irradiation is inhibited, and the residual electric potential increases. Furthermore, accumulation of the residual electric potential in repeated use is increased. Particularly, the amount is increased at lower temperatures and lower humidity. Increase of the titanium oxide amount cannot inhibit decrease of the characteristics in repeated use over a long period of time. In this connection, when the adhesive resin is almost absent, the strength of the under-coating layer decreases, adhesion between the under-coating layer and the conductive support decreases, and further decrease of the sensitivity and defectiveness of the image occur due to fracture of the under-coating layer in repeated use. In addition, the volume resistance is rapidly decreased to decrease the electrically charged property. In the invention, since the dendritic titanium oxide is used, it can be contained in a relatively large amount, and a highly sensitive and highly durable electrophotographic photoreceptor by which a faultless image can be generated can be make fit for practical use.

According to the invention as mentioned above, a highly dispersible liquid coating material for forming the under-coating layer can be obtained, of which the titanium oxide content is high and the cohesion with titanium oxide is low, because the under-coating layer contains the dendritic titanium oxide. The photoreceptor containing the under-coating layer made of the liquid coating material has almost no defectiveness by coating and inhibits decrease of the electrification and increase of the residual electric potential. In addition, accumulation of the residual electric potential is low and decrease of the photosensitivity is small. Thus, the electrophotographic photoreceptor superior in stability and environmental characteristics can be put into practice.

The invention is characterized in that a surface of the titanium oxide is coated with a metal oxide or oxides and/or an organic compound or compounds.

According to the invention, decrease of the electrically charged property and increase of the residual electric potential are inhibited by use of the dendritic titanium oxide of which the surface is coated with a metal oxide and an organic compound or by use of the dendritic titanium oxide of which the surface is coated with either a metal oxide or an organic compound. Thus, increase of accumulation of the residual electric potential in repeated use and decrease of the photosensitivity are further inhibited. In addition, cohesion of the titanium oxide particles in the liquid coating material for forming the under-coating layer can further be prevented, and gel formation in the liquid coating material can be prevented.

When the amount of titanium oxide in the under-coating layer is increased, the affinity of titanium oxide to the adhesive resin decreases, and thus dispersibility and stability of the liquid coating material for forming the under-coating layer decrease. The under-coating layer made of such a liquid coating material yields uneven coating to generate an unacceptable image. In this invention, however, since the under-coating layer contains the surface-coated dendritic titanium oxide, there is no disadvantage as mentioned above to give a highly sensitive and highly durable electrophotographic photoreceptor that can generate a faultless image.

According to the invention, since the surface of the dendritic titanium oxide contained in the under-coating layer is coated with (a) metal oxide(s) and/or (an) organic compound(s), cohesion of the titanium oxide further decreases to prevent gel formation in the liquid coating material. Moreover, decrease of the electrically charged property and increase of the residual electric potential are inhibited, and thus increase of accumulation of the residual electric potential in repeated use and decrease of the photosensitivity are further inhibited.

The invention is also characterized in that the photoreceptive layer contains a phthalocyanine pigment.

According to the invention, the photoreceptor having the photoreceptive layer containing the phthalocyanine pigment is in many cases installed in an image-forming apparatus in which an inversion development process is carried out with a laser from the absorption wavelength of the pigment. In such an image-forming apparatus, the defective photoreceptive layer or support generates, for example, a dark spotted image on a white sheet, and so requirements become further strict for dispersibility of the liquid coating material for forming the under-coating layer and for electric characteristics of the under-coating layer. The use of the under-coating layer containing the dendritic titanium oxide, of which the surface is coated with (a) metal oxide(s) and/or (an) organic compound(s) for the photoreceptive layer containing a phthalocyanine pigment, satisfies the strict requirement to give a highly sensitive and highly durable electrophotographic photoreceptor which can generate a faultless image.

It is preferable that the under-coating layer is constructed by dispersing a dendritic titanium oxide or a surface-coated dendritic titanium oxide into an adhesive resin. Thus, the dispersibility and preservation stability of the liquid coating material for forming the under-coating layer is increased to form a uniform under-coating layer while a given electric characteristics is kept between the conductive support and the photoreceptive layer. Thus, a defect of the image caused by a defect of the conductive support can be prevented.

As for the aforementioned adhesive resin, polyamide resins particularly soluble in organic solvents are preferred. Said resins are readily adapted to titanium oxide, well adhesive to the conductive support, and much flexible. Moreover, the resins do not swell nor dissolve in the liquid coating material for forming the photoreceptive layer. Accordingly, occurrence of uneven coating or defectiveness in the under-coating layer can be prevented to give much better image characteristics. Moreover, the production process is simple and the production cost is low.

As for the coating of the metal oxide to the dendritic titanium oxide surface, aluminum oxides or zirconium oxides are preferred. Moreover, the organic compound with which the dendritic titanium oxide surface is coated includes preferably silane-coupling agents, silylating agents, aluminum-type coupling agents and titanate-type coupling agents. The surface coating with the metal oxide and/or organic compound may preferably be made in an amount of 0.1% by weight to 20% by weight for the titanium oxide. Thus, the dispersibility and preservation stability of the liquid coating material for forming the under-coating layer is further increased to form a uniform under-coating layer while a given electric characteristics is kept between the conductive support and the photoreceptive layer. Thus, a defect of the image caused by a defect of the conductive support can further be prevented.

The coating thickness of the under-coating layer is preferably fixed in a range of 0.05–10 $\mu$m. When the thickness of the under-coating layer is thin, adhesion between the conductive support and the photoreceptive layer decreases to yield a defect of the image caused by the defect of the support, though durability against the environmental characteristics increases. When the coating thickness is thick, the sensitivity decreases and the durability against the environmental characteristics decreases. In the invention, however, since the under-coating layer contains dendritic titanium oxide, the contact area increases because the contact chance between the titanium oxide particles is quite often. Therefore, the coating thickness of the under-coating layer can be made thicker while lower an electric resistance is kept to suppress decrease of the sensitivity and increase of the residual electric potential. Thus, a defect of the image caused by a defect of the conductive support can be prevented, and the strength of the under-coating layer and the adhesion strength between the support and the under-coating layer can be enhanced.

According to the invention, an electrophotographic photoreceptor having a good electric property and characteristics for repetition can be put into practice by combining a photoreceptor layer containing a phthalocyanine pigment with an under-coating layer containing a dendritic titanium oxide, of which the surface is coated with (a) metal oxide(s) and/or (an) organic compound(s).

The invention is characterized in that the under-coating layer contains an alcohol-soluble polyamide resin in addition to the dendritic titanium oxide of which the surface is coated with (a) metal oxide(s) and/or (an) organic compound (s).

According to the invention, decrease of the electrically charged property and increase of the residual electric potential as well as increase of accumulation of the residual electric potential in repeated use and decrease of the photosensitivity are further inhibited by the use of an under-coating layer containing dendritic titanium oxide, of which the surface is coated with (a) metal oxide(s) and/or (an) organic compound(s), together with an alcohol-soluble polyamide resin for a photoreceptive layer containing a phthalocyanine pigment. Moreover, cohesion of the titanium oxide particles in a liquid coating material for forming the under-coating layer and gel formation for the liquid coating material can be prevented.

According to the invention, an electrophotographic photoreceptor having a good electric property and characteristics for repetition can be put into practice by combining a photoreceptive layer containing a phthalocyanine pigment with an under-coating layer containing dendritic titanium oxide, of which the surface is coated with (a) metal oxide(s) and/or (an) organic compound(s), and an alcohol-soluble polyamide. Moreover, cohesion of the titanium oxide particles in a liquid coating material for forming the under-coating layer and gel formation for the liquid coating material can be prevented.

The invention is also characterized in that the photoreceptive layer has a charge generation layer and a charge transport layer, wherein the charge generation layer contains a phthalocyanine pigment.

According to the invention, a highly sensitive and highly durable electrophotographic photoreceptor which satisfies the aforementioned strict requirement and can form a faultless image can be put into practice by using an under-coating layer containing dendritic titanium oxide, of which the surface is coated with (a) metal oxide(s) and/or (an) organic compound(s), or by using an under-coating layer containing dendritic titanium oxide, of which the surface is coated with (a) metal oxide(s) and/or (an) organic compound(s), and an alcohol-soluble polyamide, for a function-separating type photoreceptive layer in which the charge generation layer contains a phthalocyanine pigment.

According to the invention, a photoreceptive layer having a charge generation layer containing a phthalocyanine pigment is used in combination with an under-coating layer containing dendritic titanium oxide of which the surface is coated with (a) metal oxide(s) and/or (an) organic compound (s). Alternatively, a photoreceptive layer having a charge generation layer containing a phthalocyanine pigment is used in combination with an under-coating layer containing dendritic titanium oxide, of which the surface is coated with (a) metal oxide(s) and/or (an) organic compound(s), and an alcohol-soluble polyamide. Accordingly, an electrophotographic photoreceptor having a good electric property and characteristics for repetition can be put into practice.

The invention also relates to an electrophotographic photoreceptor comprising a conductive support, an under-coating layer formed on the conductive support, and a photoreceptive layer formed on the under-coating layer, wherein the above under-coating layer contains needle-like titanium oxide of which the surface is coated with (a) metal oxide(s) and/or (an) organic compound(s), and the above photoreceptive layer contains a phthalocyanine pigment.

According to the invention, the use of the needle-like titanium oxide, of which the surface is coated with (a) metal oxide(s) and/or (an) organic compound(s), contained in the under-coating layer affords high dispersibility even in a high content of titanium oxide in the liquid coating material for forming the under-coating layer. Thus, the photoreceptor having an under-coating layer prepared with such a liquid coating material has almost no defect by coating. Moreover, it has a good electrically charged property and small residual electric potential. Furthermore, accumulation of the residual electric potential in repeated use is small, and deterioration of the photosensitivity is low. Accordingly, an electrophotographic photoreceptor superior in stability and environmental characteristic can be obtained. By using the under-coating layer for a photoreceptive layer containing a phthalocyanine pigment, a highly sensitive and highly durable electrophotographic photoreceptor which satisfies the strict requirement and can generate a faultless image can be put into practice.

Similarly in the case of the dendritic titanium oxide, the under-coating layer is preferred to construct by dispersing a surface-coated needle-like titanium oxide into an adhesive resin. The aforementioned adhesive resin includes preferably polyamide resins, particularly soluble in organic solvents. As for the metal oxide with which the needle-like titanium oxide surface is coated, aluminum oxides or zirconium oxides are preferred. Moreover, the organic compound with which the needle-like titanium oxide surface is coated includes preferably silane-coupling agents, silylating agents, aluminum-type coupling agents and titanate-type coupling agents. The surface coating with the metal oxide and/or organic compound may preferably be made in an amount of 0.1% by weight to 20% by weight for the titanium oxide. The coating thickness of the under-coating layer is preferably fixed in a range of 0.05–10 μm.

According to the invention, an electrophotographic photoreceptor having a good electric property and characteristics for repetition can be put into practice by combining a photoreceptive layer containing a phthalocyanine pigment with an under-coating layer containing needle-like titanium oxide of which the surface is coated with (a) metal oxide(s) and/or (an) organic compound(s).

The invention is characterized in that the under-coating layer contains an alcohol-soluble polyamide resin in addition to the needle-like titanium oxide of which the surface is coated with (a) metal oxide(s) and/or (an) organic compound (s).

According to the invention, decrease of the electrically charged property and increase of the residual electric potential as well as increase of accumulation of the residual electric potential in repeated use and decrease of the photosensitivity are further inhibited by the use of an under-coating layer containing needle-like titanium oxide, of which the surface is coated with (a) metal oxide(s) and/or (an) organic compound(s), together with an alcohol-soluble polyamide resin for a photoreceptive layer containing a phthalocyanine pigment. Moreover, cohesion of the titanium oxide particles in a liquid coating material for forming the under-coating layer and gel formation for the liquid coating material can be prevented.

According to the invention, an electrophotographic photoreceptor having a good electric property and characteristics for repetition can be put into practice by combining a photoreceptive layer containing a phthalocyanine pigment with an under-coating layer containing needle-like titanium oxide, of which the surface is coated with (a) metal oxide(s) and/or (an) organic compound(s), and an alcohol-soluble polyamide. Moreover, cohesion of the titanium oxide particles in a liquid coating material for forming the under-coating layer and gel formation for the liquid coating material can be prevented.

The invention is also characterized in that the photoreceptive layer has a charge generation layer and a charge transport layer, and the charge generation layer contains a phthalocyanine pigment.

According to the invention, a highly sensitive and highly durable electrophotographic photoreceptor which satisfies the aforementioned strict requirement and can form a faultless image can be put into practice by using an under-coating layer containing needle-like titanium oxide, of which the surface is coated with (a) metal oxide(s) and/or (an) organic compound(s), or by using an under-coating layer containing needle-like titanium oxide, of which the surface is coated with (a) metal oxide(s) and/or (an) organic compound(s), and an alcohol-soluble polyamide resin, for a function-separating type photoreceptive layer in which the charge generation layer contains a phthalocyanine pigment.

According to the invention, a photoreceptive layer having a charge generation layer containing a phthalocyanine pigment is used in combination with an under-coating layer containing needle-like titanium oxide of which the surface is coated with (a) metal oxide(s) and/or (an) organic compound (s). Alternatively, a photoreceptive layer having a charge generation layer containing a phthalocyanine pigment is used in combination with an under-coating layer containing needle-like titanium oxide, of which the surface is coated with (a) metal oxide(s) and/or (an) organic compound(s), and an alcohol-soluble polyamide. Accordingly, an electrophotographic photoreceptor having a good electric property and characteristics for repetition can be put into practice.

The invention is also characterized in that the titanium oxide is selected from those of 1 μm or less in the short axis and 100 μm or less in the long axis.

According to the invention, since the under-coating layer contains dendritic or needle-like titanium oxide of the above size, the contact area increases because the contact chance between the titanium oxide particles is quite often. Accordingly, the value of electric resistance of the under-coating layer can be kept low in a smaller content of titanium oxide. Thus, decrease of the sensitivity and increase of the residual electric potential can be inhibited. In addition, the dispersibility and preservation stability of the liquid coating material for forming the under-coating layer is increased. Moreover, a defect of the image caused by a defect of the conductive support can be prevented, and the strength of the under-coating layer and the adhesion strength between the support and the under-coating layer can be enhanced.

According to the invention, since the under-coating layer contains the dendritic or needle-like titanium oxide of 1 μm or less in the short axis and 100 μm or less in the long axis, the contact area increases because the contact chance between the titanium oxide particles is quite often. And the value of electric resistance of the under-coating layer can be kept low in a smaller content of titanium oxide. Thus, decrease of the sensitivity and increase of the residual electric potential can be inhibited, and the dispersibility and preservation stability of the liquid coating material for forming the under-coating layer is increased. Moreover, a defect of the image caused by a defect of the conductive support can be prevented, and the strength of the under-coating layer and the adhesion strength between the support and the under-coating layer can be enhanced.

The invention is also characterized in that the needle-like titanium oxide is selected from those of which the average aspect ratio is in a range of from 1.5 to 300.

According to the invention, since the under-coating layer contains needle-like titanium oxide of the above aspect ratio, the value of electric resistance of the under-coating layer can be kept low in a smaller content of titanium oxide, and thus, decrease of the sensitivity and increase of the residual electric potential can be inhibited. In addition, the dispersibility and preservation stability of the liquid coating material for forming the under-coating layer is increased. Moreover, a defect of the image can be prevented, and the strength of the under-coating layer and the adhesion strength between the support and the under-coating layer can be enhanced.

According to the invention, in the case of the needle-like titanium oxide, it is preferred to select the aspect ratio in a range of from 1.5 to 300 in order to obtain the aforementioned effect.

The invention is also characterized by using titanium oxide which is not subjected to a conductive processing.

According to the invention, since the under-coating layer contains dendritic or needle-like titanium oxide, the contact chance between the titanium oxide particles is quite often. Thus, the value of electric resistance of the under-coating layer can be kept low in a smaller content of titanium oxide, even though no conductive processing is made on the titanium oxide surface, that is, the titanium oxide which has not been made through any conductive processing is used. Thus, decrease of the sensitivity and increase of the residual electric potential can be inhibited to obtain better electrification.

When granular titanium oxide, for instance, that of 0.01 μm or more to 1 μm or less in granular size, 1 or more to 1.3 or less of the average aspect ratio, and nearly spherical rough shape, is dispersed into an under-coating layer, the contact between the titanium oxide particles becomes point-contact to reduce the contact area. Consequently, if a large amount of titanium oxide is not used, the electric resistance of the under-coating layer would be increased, the sensitivity decreased, and the residual electric potential increased. When the content of titanium oxide increases, however, the dispersibility and preservation stability of the liquid coating material decreases, the strength of the under-coating layer decreases, and the contact strength with the conductive support decreases. When the titanium oxide surface is subjected to the conductive processing in order to reduce the electric resistance on the titanium oxide surface, the electrically charged property of the photoreceptor is reduced. It is difficult to apply the conductive processing highly precisely. In the invention, however, since the under-coating layer contains dendritic or needle-like titanium oxide, a better electrically charged property can be attained even in a smaller content of titanium oxide for which no conductive processing is made.

According to the invention, the use of the dendritic or needle-like titanium oxide to the surface of which is subjected to no conductive processing inhibits decrease of the sensitivity and increase of the residual electric potential to yield a better electrically charged property.

The invention is also characterized in that the under-coating layer contains titanium oxide in a range of from 10% by weight to 99% by weight.

According to the invention, by fixing the rate of titanium oxide to the under-coating layer as mentioned above, increase of the residual electric potential is inhibited even in a low content of titanium oxide, and an electrophotographic photoreceptor which is superior in environmental characteristics, particularly, in durability at relatively low temperatures and low humidity, can be put into practice.

According to the invention, by selecting the rate of titanium oxide to the under-coating layer in a range of from 10% by weight to 99% by weight, increase of the residual electric potential is inhibited even in a low content of titanium oxide, and an electrophotographic photoreceptor which is superior in environmental characteristics, particularly, in durability at relatively low temperatures and low humidity, can be put into practice.

The invention also relates to a method for producing an electrophotographic photoreceptor, comprising applying a liquid coating material for forming an under-coating layer to a conductive support to form an under-coating layer on the conductive support, and then forming a photoreceptive layer on the under-coating layer, wherein the liquid coating material for forming the under-coating layer comprises dendritic titanium oxide whose surface is coated with (a) metal oxide(s) and/or (an) organic compound(s), a polyamide resin soluble in organic solvents, and an organic solvent, and the organic solvent is a mixture of a solvent selected from the group consisting of lower alcohols of 1–4 carbon atoms with a solvent selected from the group consisting of dichloromethane, chloroform, 1,2-dichloroethane, 1,2-dichloropropane, toluene and tetrahydrofuran.

According to the invention, a liquid coating material for forming the under-coating layer containing the above dendritic titanium oxide is applied on the conductive support to form an under-coating layer, on which is then formed a photoreceptive layer. Such a liquid coating material for forming the under-coating layer is superior in dispersibility and preservation stability. Thus, a uniform under-coating layer can be formed.

The above under-coating layer is preferably formed by means of a dip coating method. That is, preferably, a conductive support is immersed in a liquid coating material for forming the under-coating layer and pulled up therefrom to form an under-coating layer.

According to the invention, a liquid coating material for forming the under-coating layer containing dendritic titanium oxide is applied on the conductive support to form an under-coating layer, on which is then formed a photoreceptive layer. Such a liquid coating material for forming the under-coating layer is superior in dispersibility and preservation stability. Thus, a uniform under-coating layer can be formed.

The invention also relates to a method for producing an electrophotographic photoreceptor, comprising applying a liquid coating material for forming an under-coating layer to a conductive support to form an under-coating layer on the conductive support, and forming a photoreceptive layer on the under-coating layer, wherein the liquid coating material for forming the under-coating layer comprises needle-like titanium oxide of which the surface is coated with (a) metal oxide(s) and/or (an) organic compound(s), a polyamide resin soluble in organic solvents, and an organic solvent, and the organic solvent is a mixture of a solvent selected from the group consisting of lower alcohols of 1–4 carbon atoms with a solvent selected from the group consisting of dichloromethane, chloroform, 1,2-dichloroethane, 1,2-dichloropropane, toluene and tetrahydrofuran.

According to the invention, a liquid coating material for forming the under-coating layer containing the above needle-like titanium oxide is applied on the conductive support to form an under-coating layer, on which is then formed a photoreceptive layer. Such a liquid coating material for forming the under-coating layer is superior in dispersibility and preservation stability. Thus, a uniform under-coating layer can be formed.

The above under-coating layer is preferably formed by means of a dip coating method. That is, preferably, a conductive support is immersed in a liquid coating material for forming the under-coating layer and pulled up therefrom to form an under-coating layer.

According to the invention, a liquid coating material for forming the under-coating layer containing needle-like titanium oxide is applied on the conductive support to form an under-coating layer, on which is then formed a photoreceptive layer. Such a liquid coating material for forming the under-coating layer is superior in dispersibility and preservation stability. Thus, a uniform under-coating layer can be formed.

The invention also relates to an image-forming apparatus in which an inversion development process is carried out using an electrophotographic photoreceptor, which is one of the aforementioned electrophotographic photoreceptors.

According to the invention, the photo-receptors are adapted to an image-forming apparatus in which an image is generated via an inversion development process, and thus, a characteristically better and faultless image can be generated. Accordingly, the image-forming apparatus can be used in combination with an image processing apparatus, facsimile apparatus, or printer.

According to the invention, by adapting the photoreceptors to an image-forming apparatus in which an image is generated via an inversion development process, a characteristically better and faultless image can be generated.

The preferred form of the titanium oxide particles contained in the under-coating layer is of dendrites. The term "dendric" indicates a long and dendritic shape including rod, pillar and spindle shapes. Therefore, it is not necessarily an extremely long and narrow nor sharp-pointed shape.

In addition, it is preferable that the titanium oxide particles contained in the under-coating layer are shaped like needles. The term "needle-like" indicates a long shape including rod, pillar and spindle shapes, in which the aspect ratio, the ratio of the long axis a to the short axis b, i.e. a/b, is 1.5 or more. Therefore, it is not necessarily an extremely long and narrow nor sharp-pointed shape. The average aspect ratio is preferably in a range of from 1.5 to 300, more particularly from 2 to 10. When the ratio is smaller than this range, the effect as needles can hardly be attained, and the effect is not altered even though the range is larger than this range.

As shown in FIG. 3, the size of the dendrite titanium oxide particles is preferably of 1 $\mu$m or less in the short axis b and 100 $\mu$m or less in the long axis a, and more particularly 0.5 $\mu$m or less in the short axis b and 10 $\mu$m or less in the long axis a. When the particle size does not fall into this range, it is difficult to prepare a highly dispersible and highly preservative liquid coating material for forming the under-coating layer even though the surface of titanium oxide is coated with (a) metal oxide(s) and/or (an) organic compound (s).

The needle-like titanium oxide also refers to the dendritic ones of long shapes other than dendritic ones including rods, pillars and spindles.

The particle size and aspect ratio may be determined by means of weight sedimentation or optically transmitting particle size distribution, but it is preferred to observe titanium oxide under an electron microscope for direct measurement because it is dendritic or needle-like.

Though the under-coating layer contains dendritic or needle-like titanium oxide, in order to keep the dispersibility of titanium oxide in a liquid coating material for forming the under-coating layer for a long period of time to form a uniform under-coating layer, the under-coating layer is preferred to further contain an adhesive resin. The percentage of the dendritic or needle-like titanium oxide content to the under-coating layer is preferably in a range of from 10% by weight to 99% by weight, more particularly from 30% by weight to 99% by weight, or most particularly from 35% by weight to 95% by weight. When the content is lower than 10% by weight, the sensitivity decreases and the electric charge is accumulated in the under-coating layer to increase the residual electric potential. Particularly, deterioration apparently occurs for characteristics in repetition at low temperatures and low humidity. The content larger than 99% by weight is not preferred because the preservation stability of the liquid coating material for forming the under-coating layer decreases to readily yield deposit of the dendritic or needle-like titanium oxide.

Alternatively, the dendritic or needle-like titanium oxide may be added to the under-coating layer in combination with granular titanium oxide particles. The dendritic, needle-like and granular crystals of titanium oxide include those of anatase-, rutile- and amorphous-types, any of which may be used alone or as a mixture of two or more.

The volume resistance of powdered titanium oxide particles is preferably in a range of $10^5$ Ω·cm–$10^{10}$ Ω·cm. When the volume resistance of the powder is smaller than $10^5$ Ω·cm, the resistance of the under-coating layer decreases and the function as a charge-blocking layer is lost. For example, as in an antimony-doped tin oxide conductive layer, the under-coating layer containing metal oxide particles to which a conductive processing has been applied has a remarkably low powder volume resistance of $10^0$ Ω·cm–$10^1$ Ω·cm. Such an under-coating layer cannot function as a charge-blocking layer to decrease the electrification and cannot be used because fog or dark spots occur in the image. When the volume resistance of the powder is larger than $10^{10}$ Ω·cm and equivalent to or larger than that of the adhesive resin itself, the resistance as the under-coating layer is so high to inhibit and block transportation of the carrier generated by photo-irradiation, and the residual electric potentail increases and the photosensitivity decreases.

In order to keep the volume resistance of the titanium oxide particle powder in the aforementioned range, the surface of titanium oxide particles is preferably coatedwith an aluminum oxide or zirconium oxide. In particular, it may preferably be coated with a metal oxide such as $Al_2O_3$, $ZrO_2$ or their mixture. When surface-uncoated titanium oxide particles are used, the particles in a liquid coating material for forming the under-coating layer, which is even well dispersed, aggregate in use or preservation of the liquid coating material for a long period of time since the uncoated titanium oxide is fine particles. In the resulting under-coating layer, defects or uneven coating occur to yield image defects. In addition, a charge injection from the conductive support readily occurs and the electrically charged property in a small area is decreased to yield dark spots. As mentioned above, by coating the surface of titanium oxide particles with a metal oxide such as $Al_2O_3$, $ZrO_2$ or their mixture, cohesion of titanium oxide is prevented, and thus, a liquid coating material for forming the under-coating layer superior in dispersibility and preservation stability can be obtained. Thus, since the charge injection from the conductive support can be prevented, an electrophotographic photoreceptor generating a spotless better image can be obtained.

The metal oxide with which is coated the surface of titanium oxide includes preferably $Al_2O_3$ and $ZrO_2$, but in order to obtain a better image character, it is appropriate to coat the surface with $Al_2O_3$ and $ZrO_2$. When the surface is coated with $SiO_2$, the surface becomes hydrophilic but scarcely adapt for organic solvents and the dispersibility of titanium oxide is decreased to readily cause adhesion. In such a case, it is unsuitable for long-term use. Alternatively, when the surface is coated with a magnetic metal oxide such as $Fe_2O_3$, chemical interaction takes place with a phthalocyanine pigment contained in the photoreceptive layer to decrease the electric characteristics of the photoreceptor, particularly, sensitivity and electrically charged property. This should be avoided, accordingly.

The coating of the titanium oxide surface with a metal oxide such as $Al_2O_3$ and $ZrO_2$ may preferably be achieved in a range of from 0.1% by weight to 20% by weight to titanium oxide. When the surface-coating amount is lower than 0.1% by weight, the surface of titanium oxide is not covered sufficiently, and so the coating effect is hardly attained. When the coating amount is larger than 20% by weight, the coating effect is not altered practically, but the cost is not acceptable.

In order to keep the volume resistance of the powdered titanium oxide particles in the aforementioned range, the surface of the particles is preferably coated with an organic compound. The organic compound used in the surface coating for titanium oxide includes conventional coupling agents. Examples of the coupling agents are silane-coupling agents, e.g., alkoxysilane compounds, silylating agents in which a halogen, nitrogen or sulfur atom is attached to silicon, titanate-type coupling agents, and aluminum-type coupling agents.

The silane-coupling agent is exemplified by alkoxysilane compounds such as tetramethoxysilane, methyltrimethoxysilane, dimethyldimethoxysilane, ethyltrimethoxysilane, diethyldimethoxysilane, phenyltriethoxysilane, aminopropyltrimethoxysilane, γ-(2-aminoethyl)aminopropylmethyldimethoxysilane, allyltrimethoxysilane, allyltriethoxysilane, 3-(1-aminopropoxy)-3,3-dimethyl-1-propenyltrimethoxysilane, (3-acryloxypropyl)trimethoxysilane, (3-acryloxypropyl) methyldimethoxysilane, (3-acryloxypropyl) dimethylmethoxysilane and N-3-(acryloxy-2-hydroxypropyl)-3-aminopropyltriethoxysilane; chlorosilanes such as methyltrichlorosilane, methyldichlorosilane, dimethyldichlorosilane and phenyltrichlorosilane; and silazanes such as hexamethyldisilazane and octamethylcyclotetrasilazane. The titanate-type coupling agent includes, for example, isopropyltriisostearoyl titanate and bis(dioctylpyrophosphate). The aluminum-type coupling agent includes, for example, acetoalkoxyaluminium diisopropylate and the like. The coupling agents are not limited to these compounds.

When the surface of titanium oxide is coated with these coupling agents or these coupling agents are used as dispersing agents, one or more of them may be used together.

The methods for coating the surface of titanium oxide may be classified into a pretreatment method and an integral blend method. The pretreatment method is further classified into a wet method and dry process. The wet method is divided into a water-processing method and a solvent-processing method.

The water-processing method includes a directly dissolving method, emulsion method and amine-adduct method. In the wet method, a surface-treating agent is dissolved or suspended in an organic solvent or water, to which is added titanium oxide, and the mixture is stirred for a period of several minutes to about 1 hour, and if required, treated under heating, and dried after filtration and so on to coat the surface of titanium oxide. Alternatively, the surface-treating agent may be added to a suspension of titanium oxide dispersed in an organic solvent or water. As for the surface-treating agent, water-soluble items in the directly dissolving method, water-emulsifiable items in the emulsion method, and items containing a phosphate residue in the amine-adduct method may be employed. In the amine-adduct method, the mixture is adjusted at pH 7–10 by adding a small amount of a tertiary amine such as trialkylamine and trialkylolamine, and treated under cooling to suppress elevation of the liquid temperature caused by exothermic neutralization reaction. In the other steps, the mixture may be treated for the surface coating in the same manner as in the wet method. The surface-treating agent utilizable in the wet method is limited to those soluble or suspensible in organic solvents or water.

In the dry process, a surface-treating agent is added directly to titanium oxide, and the mixture is agitated by means of a mixer to form the coat on the surface. In general, it is preferred to dry preliminarily titanium oxide to remove moisture on the surface. For example, the preliminary dry is carried out under stirring at several ten rpm with a mixer, such as hayshal mixer, at a temperature of about 100° C., and then a surface-treating agent is added directly or as a solution or suspension in an organic solvent or water. In this operation, the agent is sprayed with dry air or $N_2$ gas more homogeneously. After addition of the surface-treating agent, the mixture is preferably stirred at a temperature of about 80° C. at a rotation rate of 1,000 rpm or higher for several ten minutes.

The integral blend method is a conventional method generally employed in the field of painting, wherein a surface-treating agent is added during kneading of titanium oxide with a resin to coat the surface. The amount of the surface-treating agent to be added is determined according to the kind and form of titanium oxide, for example, in a range of 0.01% by weight–30% by weight, preferably, a range of 0.1% by weight–20% by weight. If the amount added is smaller than this range, the effect of the addition is scarcely recognized. If the amount added is larger than this range, the coating effect is not altered practically, but the cost is put at a disadvantage.

Before or after the treatment wherein a coupling agent having an unsaturation is used, or in the case of adding a coupling agent as a dispersant into an organic solvent, in order to keep the volume resistance of the powdered titanium oxide particles in the aforementioned range, it is preferred to keep the titanium oxide surface intact to conductive processing, or alternatively it is appropriate to coat the titanium oxide surface with a metal oxide such as $Al_2O_3$, ZrO, $ZrO_2$ or their mixture or with an organic compound without conductive processing.

As for the adhesive resin contained in the under-coating layer, the same materials as used in formation with a resin unilayer can be used. For example, polyethylene, polypropylene, polystyrene, acryl resin, vinyl chloride resin, vinyl acetate resin, polyurethane resin, epoxy resin, polyester resin, melamine resin, silicone resin, poly (vinyl butyral) resin, polyamide resin, copolymer resin which contains two or more of these repeated units, casein, gelatin, polyvinyl alcohol, and ethylcellulose may be used. Particularly, the polyamide resins are preferred. The reason is that they as the character of the adhesive resin do not dissolve nor swell in solvents used in formation of the photoreceptive layer on the under-coating layer. Moreover, they are well adhesive to the conductive support and have better flexibility. Among the polyamide resins, alcohol-soluble nylon resins are particularly preferred, practically including the so-called copolymer nylons produced by copolymerization from nylon-6, nylon-66, nylon-610, nylon-11 and nylon-12, and chemically denatured nylons such as N-alkoxymethyl denatured nylons, N-alkoxyethyl denatured nylons, and the like.

As for the organic solvents used in the liquid coating materials for forming the under-coating layer, conventional ones can be employed. When an alcohol-soluble nylon resin is used as an adhesive resin, a mixture of an organic solvent selected from the group consisting of lower alcohols of 1–4 carbon atoms with an organic solvent selected from the group consisting of dichloromethane, chloroform, 1,2-dichloroethane, 1,2-dichloropropane, toluene and tetrahydrofuran. Particularly, an azeotropic mixture of a lower alcohol selected from the group consisting of methanol, ethanol, isopropanol and n-propanol with another organic solvent selected from the group consisting of dichloromethane, chloroform, 1,2-dichloroethane, 1,2-dichloropropane, toluene and tetrahydrofuran is preferred.

The liquid coating material prepared by dispersing a polyamide resin and titanium oxide in the mixture-type organic solvent, preferably azeotropic organic solvent mixture, is applied onto the conductive support and dried to give an under-coating layer.

The use of the mixed organic solvents improves preservation stability of the liquid coating material more than the single use of alcohol solvents, and enables regeneration of the liquid coating material. In the following illustration, the preservation stability is referred to as "pot life" indicating the number of days passing from the date when the liquid coating material for forming the under-coating layer was made.

The under-coating layer may preferably be formed by immersing a conductive support into a liquid coating material for forming the under-coating layer. Since the dispersibility and preservation stability of the liquid coating material for forming the under-coating layer is improved, coating defects and uneven coating are prevented to yield homogeneously coated photoreceptive layer on the under-coating layer, with which an electrophotographic photoreceptor having a faultless better image character can be produced.

The azeotropic mixture means a liquid mixture boiling at a constant temperature, in which the composition of the liquid is identical with that of the vapor. Such a composition can be determined by an optional combination of a solvent selected from the group consisting of the above lower alcohols with a solvent selected from the group consisting of dichloromethane, chloroform, 1,2-dichloroethane, 1,2-dichloropropane, toluene and tetrahydrofuran; for example, the compositions described in Chemical Handbook, Basic (Maruzen Co., Ltd., Copyright: the Chemical Society of Japan) can be employed. Practically, in the case of a mixture of methanol and 1,2-dichloroethane, the azeotropic component compirses 35 parts by weight of methanol and 65 parts by weight of 1,2-dichloroethane. By this azeotropic component, a constant vaporization takes place to form a faultless homogeneous film of the under-coating layer. The preservation stability of the liquid coating material for forming the under-coating layer is also improved.

The coating thickness of the under-coating layer is preferably fixed in a range of from 0.01 $\mu$m to 20 $\mu$m, particularly in from 0.05 $\mu$m to 10 $\mu$m. When the thickness is smaller than 0.01 $\mu$m, the under-coating layer does not function practically and a uniform surface covering the defect of the conductive support cannot be obtained. Thus, a carrier injection from the conductive support cannot be prevented to decrease the electrically charged property. It is difficult to make the coating thickness thicker than 20 $\mu$m by the dip coating method, and it is not preferred since sensitivity of the photoreceptor is decreased.

As for the methods for dispersing the liquid coating material for forming the under-coating layer, those using a ball mill, sand mill, atriter, vibrating mill or ultrasonic disperser may be used. As for the coating means, a conventional method such as the aforementioned immersion-coating method can be used.

As for the conductive support, a metallic cylinder or sheet, e.g. aluminum, aluminum alloy, copper, zinc, stainless steel or titanium, may be exemplified. In addition, a cylinder or sheet or seamless belt prepared by performing a metal foil lamination or metal vapor deposition on a macro-molecular material, e.g. polyethylene terephthalate, nylon or polystyrene, or on a hard paper may be exemplified.

As for the structure of photoreceptive layer formed on the under-coating layer, there are two types, that is, a function-separating type consisting of two layers, i.e. charge generation layer and charge transport layer, and a monolayer type in which the two layers are not separated to form a monolayer. Either of them may be employed.

In the function-separating type, the charge generation layer is formed on the under-coating layer. The charge generation material contained in the charge generation layer includes bis-azo-type compounds, e.g. chlorodiane blue, polycyclic quinone compounds, e.g. dibromoanthanthrone, perillene type compounds, quinacridone type compounds, phthalocyanine type compounds and azulenium salt compounds. One or more species of them may be used in combination.

The charge generation layer may be prepared by vapor deposition of a charge generation material in vacuum or by dispersing it into a solution of adhesive resin and applying the solution. In general, the latter is preferred. In the latter case, the same method as in preparation of the under-coating layer may be applied in order to carry out mixing and dispersion of the charge generation material into a solution of adhesive resin and subsequent coating of the coating suspension for forming the charge generation layer.

The adhesive resin used for the charge generation layer includes melamine resins, epoxy resins, silicone resins, polyurethane resins, acryl resins, polycarbonate resins, polyarylate resins, phenoxy resins, butyral resins, and copolymer resins containing two or more of their repeating units, as well as insulating resins such as copolymer resins, e.g. vinyl chloride-vinyl acetate copolymer, acrylonitrile-styrene copolymer. The resin is not limited to them, and all of the usually used resins may be used alone or in combination of two or more species.

The solvent in which the adhesive resin for the charge generation layer is dissolved includes halogenohydrocarbons, e.g. dichloromethane, dichloroethane, ketones, e.g. acetone, methyl ethyl ketone, cyclohexanone, esters, e.g. ethyl acetate, butyl acetate, ethers, e.g. tetrahydrofuran, dioxane, aromatic hydrocarbons, e.g. benzene, toluene, xylene, and aprotic polar solvents, e.g. N,N-dimethylformamide, N,N-dimethylacetamide.

The coating thickness of the charge generation layer may be in a range of from 0.05 $\mu$m to 5 $\mu$m, preferably, from 0.1 $\mu$m to 1 $\mu$m.

In preparing the charge transport layer provided on the charge generation layer, in general, a charge-transforming material is dissolved in an adhesive resin solution to give a coating solution for forming the charge transport layer, which is then applied to give a coating film. The charge transport material contained in the charge transport layer includes hydrazone-type compounds, pyrazoline-type compounds, triphenylamine-type compounds, triphenylmethane-type compounds, stilbene-type compounds, and oxadiazole-type compounds. These may be used alone or in combination of two or more species.

As to the adhesive resin for the charge transport layer, the aforementioned resin used for the charge generation layer may be used alone or in combination of two or more species. The charge transport layer may be prepared in the same manner as in the under-coating layer. The coating thickness of the charge transport layer is preferably fixed in a range of from 5 $\mu$m to 50 $\mu$m, particularly in from 10 $\mu$m to 40 $\mu$m.

When the photoreceptive layer is a monolayer, the coating thickness of photoreceptive layer is preferably fixed in a range of from 5 $\mu$m to 50 $\mu$m, particularly in from 10 $\mu$m to 40 $\mu$m.

In any case of the monolayer-type and function-separating type, the photoreceptive layer may preferably be charged negatively. This is conducted to make the under-coating layer barrier against Hall injection from the conductive support and to raise the sensitivity and durability.

Moreover, in order to improve the sensitivity and reduce the residual electric potential and the fatigue in repeated use, it is acceptable to add at least one or more of electron receptive materials. The electron receptive material includes, for example, quinone type compounds, e.g. parabenzoquinone, chloranil, tetrachloro-1,2-benzoquinone, hydroquinone, 2,6-dimethylbenzoquinone, methyl-1,4-benzoquinone, α-naphthoquinone, and β-naphthoquinone; nitro compounds, e.g. 2,4,7-trinitro-9-fluorenone, 1,3,6,8-tetra-nitrocarbazole, p-nitrobenzophenone, 2,4,5,7-tetra-nitro-9-fluorenone and 2-nitrofluorenone; and cyano compounds, e.g. tetracyanoethylene, 7,7,8,8-tetra-cyanoquinodimethane, 4-(p-nitrobenzoyloxy)-2',2'-dicyanovinylbenzene and 4-(m-nitrobenzoyloxy)-2',2'-dicyanovinylbenzene. Among these compounds, the fluorenone type compounds, quinone type compounds and the benzene derivatives substituted by an electron attracting group such as Cl, CN, $NO_2$, and the like are particularly preferred.

In addition, ultraviolet absorbents or anti-oxidants such as nitrogen-containing compounds, for example, benzoic acid, stilbene compounds or their derivatives, triazole compounds, imidazole compounds, oxadiazole compounds, thiazole compounds and their derivatives may be contained.

Moreover, if required, a protective layer may be provided in order to protect the surface of photoreceptive layer. As for the protective layer, a thermoplastic resin or light- or thermo-setting resin may be used. In the protective layer, an inorganic material such as the aforementioned ultraviolet absorbent, antioxidant or metal oxide, organic metallic compound and electron attracting substance may be contained. In addition, if required, a plasticizer or plasticizers such as dibasic acid ester, fatty acid ester, phosphoric acid ester, phthalic acid ester and chlorinated paraffin may be added to the photoreceptive layer and the surface protective layer to give workability and plasticity for the purpose of improving mechanical property. A leveling agent such as silicone resin may also be added.

The electrophotographic photoreceptor having the under-coating layer of the invention has a uniform coating thickness and negligible coating defects, and so the coating thickness of the photoreceptive layer becomes uniform to cover the defects of the conductive support. Thus, an electrophotographic photoreceptor which is superior in electric and environmental characteristics and has very few defects can be produced. When this photoreceptor is installed on an image-forming apparatus having a reverse development process, the image defect caused by defects of the photoreceptor, that is, a dark spotted image occurring on a white sheet, can be reduced to generate a better image character having no image unevenness due to uneven coating.

By using the dendritic titanium oxide or by using the dendritic or needle-like titanium oxide of which the surface is coated with (a) metal oxide(s) and/or (an) organic compound(s), a liquid coating material for forming the under-coating layer can be obtained, in which cohesion between the titanium oxide particles is inhibited to bring out the better dispersibility and preservation stability. Moreover, the charge injection from the conductive support is suppressed to generate a better image character.

By using a mixture of a lower alcohol and another organic solvent, particularly an azeotropic mixture, used in the liquid coating material for forming the under-coating layer, a more stable dispersibility can be obtained, and the stability is retained over a long period of time. Accordingly, a uniform coating film is formed to generate a better image character.

Moreover, since the dendritic or needle-like titanium oxide is a long and narrow particle, when formed into the under-coating layer, the chance of contact each other between the particles increases to broaden the contact area. Accordingly, it is possible to make easily an under-coating layer having a capacity equivalent to that prepared from granular titanium oxide, even though the content of the titanium oxide particles in the under-coating layer is reduced. Since the titanium oxide content can be reduced, the coating strength of the under-coating layer and the adhesion to the conductive support can be improved. No deterioration occurs in the electric character and image character even after repeated use for a long period of time, and a highly stable electrophotographic photoreceptor can be obtained.

When the titanium oxide content is the same, the under-coating layer containing the dendritic or needle-like titanium oxide exhibits lower electric resistance than that containing the granular one, and the coating thickness can be increased, accordingly. Thus, since no surface defect of the conductive support is exposed, it is advantageous to provide a flat surface of the under-coating layer.

These effects can further be enhanced by coating the titanium oxide surface with 2 or more of metal oxides and/or organic compounds.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
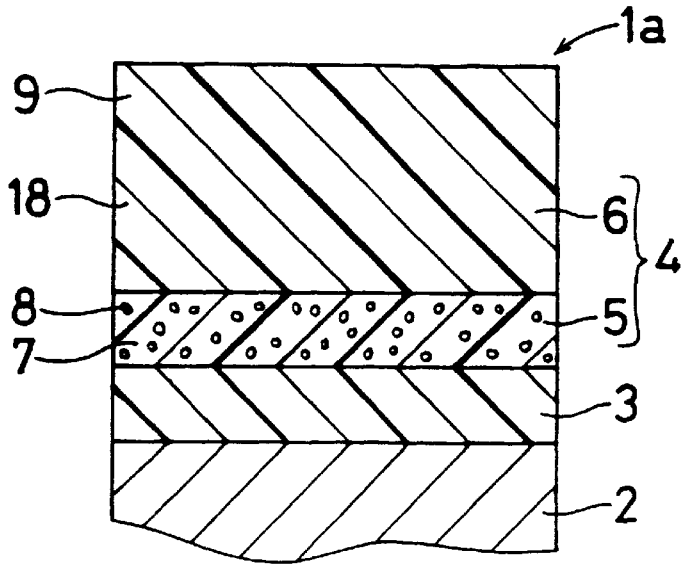
FIG. 1A and FIG. 1B show cross sections of the electrophotographic photoreceptors 1*a* and 1*b*, respectively, each of which is one embodiment of the invention.

Now referring to the drawings, preferred embodiments of the invention are described below.

The following examples illustrate an electrophotographic photoreceptor, a process for producing an electrophotographic photoreceptor, and an image-forming apparatus of the invention based on the figures, but they are not intended to limit the scope of the invention.

Figure 1B:
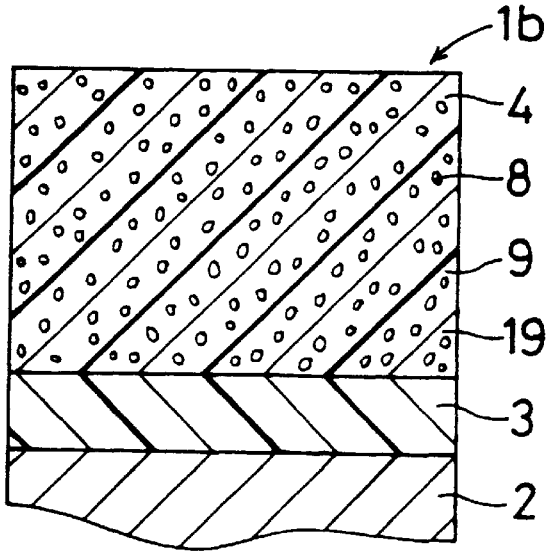

The photoreceptor 1*a* shown in FIG. 1A is of a function-separating type, in which the photoreceptive layer 4 consists of the charge generation layer 5 and the charge transport layer 6, independently. The charge generation layer 5 formed on the under-coating layer 3 is constructed with the adhesive resin 7 and the charge generation material 8. The charge transport layer 6 formed on the charge generation layer 5 is constructed with the adhesive resin 18 and the charge transport material 9. The photoreceptor 1*b* shown in FIG. 1B is of a monolayer type, in which the photoreceptive layer 4 is a monolayer. The photoreceptive layer 4 is constructed with the adhesive resin 19, the charge generation material 8 and the charge transport material 9.

Figure 2:
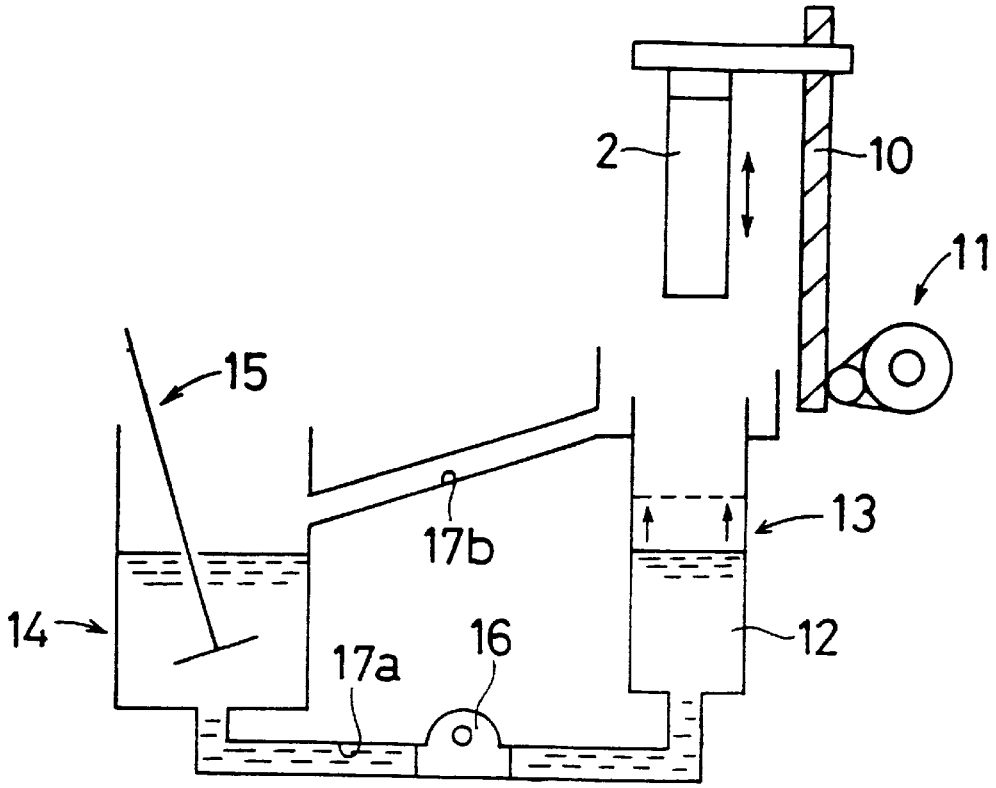
FIG. 2 shows a dip coating apparatus.

FIG. 2 shows a dip coating apparatus for illustrating a process for producing the electrophotographic receptors 1*a* and 1*b*. The liquid coating material 12 is placed in the liquid coating material vessel 13 and the stirring vessel 14. The liquid coating material 12 is transported from the stirring vessel 14 to the liquid coating material vessel 13 through the circulation path 17*a* by a motor 16. The liquid coating material 12 is further sent from the vessel 13 to the stirring vessel 14 through the downward inclined circulation path 17*b* which connects the vessel 14 with the upper part of the vessel 13. The coating material is thus circulated. The support 2 is attached to the rotary axle 10 placed above the vessel 13. The axle direction of the rotary axle 10 is along the vertical of the vessel 13. By rotation of the rotary axle 10 with the motor 11, the support 2 attached thereto goes up and down.

The support 2, when the motor 11 is rotated to the prefixed direction to lower it, is immersed into the liquid coating material 12 in the vessel 13. Then, the support 2 is pulled out from the coating material 12 by rotating the motor 11 to the reverse direction as mentioned above, and dried to form a film with the liquid coating material 12. The under-coating layer 3, the charge generation layer 5 and charge transport layer 6 of the function-separating type, and the monolayer-type photoreceptive layer 4 may be formed by means of such an immersion-coating method.

EXAMPLE 1

The following components were dispersed with a paint shaker for 10 hours to give a liquid coating material for forming the under-coating layer.

Liquid Coating Material for Forming the Under-Coating Layer

| | |
|---|---|
| Titanium oxide (dendritic rutile-type; the surface treated with $Al_2O_3$ and $ZrO_2$; titanium content 85%): TTO-D-1 (Product of Ishihara Sangyo Kaisha Ltd.) | 3 weight parts |
| Methanol | 35 weight parts |
| 1,2-Dichloroethane | 65 weight parts |

An aluminum conductive support of 100 $\mu$m in thickness was used as the conductive support 2, on which was applied a liquid coating material for forming the under-coating layer with a Baker applicator. The support was dried at 110° C. under hot air for 10 minutes to give the under-coating layer 3 of 1.0 $\mu$m in dry thickness.

Subsequently, components were dispersed with a ball mill for 12 hours to give a coating suspension for making the photoreceptive layer. Then, the coating suspension was applied on the under-coating layer 3 with a Baker applicator, and dried at 100° C. under hot air for 1 hour to give the photoreceptive layer 4 of 20 $\mu$m in dry thickness. Thus, the electrophotographic photoreceptor 1*b* of monolayer type was produced.

Coating Suspension for Forming the Photoreceptive Layer

| | |
|---|---|
| Non-metallic Phthalocyanine of τ-type: Liophoton TPA-891 (Product of Toyo Ink Mfg. Co., Ltd.) | 17.1 weight parts |
| Polycarbonate resin: Z-400 (Product of Mitsubishi Gas Chemical Co. Inc.) | 17.1 weight parts |
| Hydrazone-type compound of the following formula: (structural formula 1) | 17.1 weight parts |

-continued

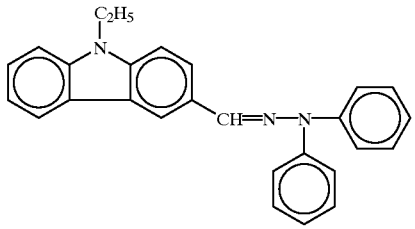

| | |
|---|---|
| Diphenoquinone compound of the following formula: (structural formula 2) | 17.1 weight parts |

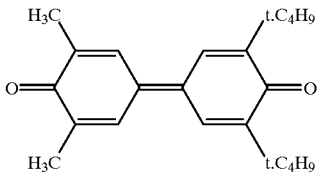

| | |
|---|---|
| Tetrahydrofuran | 100 weight parts |

EXAMPLE 2

Using the liquid coating material for forming the under-coating layer produced as above, the under-coating layer 3 was provided on the conductive support 2 in the same manner. Then, the following components were dispersed with a ball mill for 12 hours to prepare a coating suspension for forming the charge generation layer. Then, the coating suspension was applied on the under-coating layer 3 with a Baker applicator, and dried at 120° C. under hot air for 10 minutes to give the charge generation layer 5 of 0.8 $\mu$m in dry thickness.

Coating Suspension for Forming the Charge Generation Layer

| | |
|---|---|
| Non-metallic Phthalocyanine of τ-type: Liophoton TPA-891 (Product of Toyo Ink Mfg. Co., Ltd.) | 2 weight parts |
| Vinyl chloride-vinyl acetate-maleic acid copolymer resin: SOLBIN M (Product of Nisshin Chemical Co., Ltd.) | 2 weight parts |
| Methyl ethyl ketone | 100 weight parts |

Further, the following components were mixed, stirred and dissolved to prepare a coating solution for charge transport layer. Then, this coating solution was applied on the charge generation layer 5 with a Baker applicator, and dired at 80° C. under hot air for 1 hour to give the charge transport layer 6 of 20 $\mu$m dry thickness. Thus, the electrophotographic photoreceptor 1*a* of function-separating type was produced.

Coating Solution for Forming the Charge Transport Layer r

| | |
|---|---|
| Hydrazone-type compound of the following formula: (structural formula 3) | 8 weight parts |

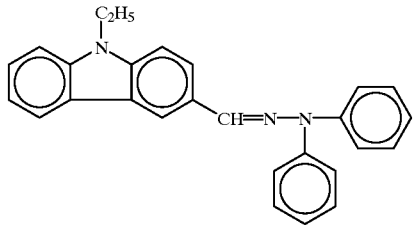

| | |
|---|---|
| Polycarbonate resin: K1300 (Product of Teijin Chemical Ltd.) | 10 weight parts |
| Silicone oil: KF50 (Product of Shin-Etsu Chemical Co., Ltd.) | 0.002 weight part |
| Dichloromethane | 120 weight parts |

EXAMPLE 3

In the same manner as in Example 1, the under-coating layer 3 was provided, provided that the components of the liquid coating material for forming the under-coating layer used in Example 1 were altered as follows. Then, the photoreceptive layer 4 was provided in the same manner as in Example 2 to produce the electrophotographic photoreceptor 1*a* of function-separating type.

Liquid Coating Material for Forming the Under-Coating Layer

| | |
|---|---|
| Titanium oxide (dendritic rutile-type; the surface treated with $Al_2O_3$ and $ZrO_2$, and stearic acid; titanium content 80%): TTO-D-2 (Product of Ishihara Sangyo Kaisha Ltd.) | 3 weight parts |
| Methanol | 35 weight parts |
| 1,2-Dichloroethane | 65 weight parts |

EXAMPLE 4

In the same manner as in Example 1, the under-coating layer 3 was provided, provided that the components of the liquid coating material for forming the under-coating layer as used in Example 1 were altered as follows. Then, the photoreceptive layer 4 was provided in the same manner as in Example 2 to produce the electrophotographic photoreceptor 1*a* of function-separating type.

Liquid Coating Material for Forming the Under-Coating Layer

| | |
|---|---|
| Titanium oxide (dendritic rutile-type; the surface treated with $Al_2O_3$; titanium content 97%): TTO-MI-1 (Product of Ishihara Sangyo Kaisha Ltd.) | 3 weight parts |
| Methanol | 35 weight parts |
| 1,2-Dichloroethane | 65 weight parts |

EXAMPLE 5

In the same manner as in Example 1, the under-coating layer 3 was provided, provided that the components of the liquid coating material for forming the under-coating layer as used in Example 1 were altered as follows and the drying was conducted at 120° C. for 20 minutes. Then, the photoreceptive layer 4 was provided in the same manner as in Example 1 to produce the electrophotographic photoreceptor 1*b* of monolayer type.

Liquid Coating Material for Forming the Under-Coating Layer

| | |
|---|---|
| Titanium oxide (dendritic rutile-type; the surface treated with $Al_2O_3$, $ZrO_2$; titanium content 85%): TTO-D-1 (Product of Ishihara Sangyo Kaisha Ltd.) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

EXAMPLE 6

In the same manner as in Example 5, the under-coating layer 3 was provided using the same liquid coating material for forming the under-coating layer as used in Example 5. Then, the photoreceptive layer 4 was provided in the same manner as in Example 2 to produce the electrophotographic photoreceptor 1*a* of function-separating type.

EXAMPLES 7–10

In the same manner as in Example 5, the under-coating layer 3 was provided, provided that the components of the liquid coating material for forming the under-coating layer in Examples 7–10 were altered as follows. Then, the photoreceptive layer 4 was provided in the same manner as in Example 2 to produce the electrophotographic photoreceptor 1*a* of function-separating type.

Liquid Coating Material for Forming the Under-Coating Layer (Example 7)

| | |
|---|---|
| Titanium oxide (dendritic rutile-type; the surface treated with $Al_2O_3$ and $ZrO_2$, stearic acid; titanium content 80%): TTO-D-2 (Product of Ishihara Sangyo Kaisha Ltd.) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

Liquid Coating Material for Forming the Under-Coating Layer (Example 8)

| | |
|---|---|
| Titanium oxide (dendritic rutile-type; the surface treated with $Al_2O_3$; titanium content 97%): TTO-MI-1 (Product of Ishihara Sangyo Kaisha Ltd.) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

Liquid Coating Material for Forming the Under-Coating Layer (Example 9)

| | |
|---|---|
| Titanium oxide (dendritic rutile-type; the surface treated with $Al_2O_3$ and $ZrO_2$; titanium content 85%): TTO-D-1 (Product of Ishihara Sangyo Kaisha Ltd.) | 3 weight parts |
| Epoxy resin: BPO-20E (Product of Rikenn Chemical Co., Ltd.) | 3 weight parts |
| Methanol | 70 weight parts |
| Water | 30 weight parts |

Liquid Coating Material for Forming the Under-Coating Layer (Example 10)

| | |
|---|---|
| Titanium oxide (dendritic rutile-type; the surface treated with $Al_2O_3$ and $ZrO_2$; titanium content 85%): TTO-D-1 (Product of Ishihara Sangyo Kaisha Ltd.) | 3 weight parts |
| Vinyl chloride-vinyl acetate-vinyl alcohol copolymer resin: SOLBIN A (Product of Nisshin Chemical Co., Ltd.) | 3 weight parts |
| Methanol | 70 weight parts |
| Water | 30 weight parts |

The respective photoreceptors 1*a* and 1*b* produced as in Examples 1–10 were put around an aluminum cylinder of a remodeled digital copying machine of AR-5030 (Sharp Co., Ltd.), on which a totally white image was made by means of an inversion development mode. There was no defective image in any cases of Examples 1–10 yielding better images. In the liquid coating materials of Examples 1–4, however, occurrence of some aggregates of titanium oxide as sediment was observed underneath of the solution in a pot-life test after preservation for 30 days at room temperature in a dark place. At the 30th day of the pot life, the respective photoreceptors 1*a* and 1*b* were made in the same way as mentioned in Examples 1–10 to form images thereon. Some dark-spotted defects were observed on the images.

COMPARATIVE EXAMPLE 1

In the same manner as in Example 1, the under-coating layer 3 was provided, provided that the components of the liquid coating material for forming the under-coating layer used in Example 1 were altered as follows. Then, the photoreceptive layer 4 was provided in the same manner as in Example 1 to produce the electrophotographic photoreceptor 1*b* of monolayer type.

Liquid Coating Material for Forming the Under-Coating Layer

| | |
|---|---|
| Titanium oxide (surface-untreated particles; titanium oxide content 98%): TTO-55N (Product of Ishihara Sangyo Kaisha Ltd.) | 3 weight parts |
| Methanol | 35 weight parts |
| 1,2-Dichloroetyhane | 65 weight parts |

Using the photoreceptor 1*b* produced as above, a totally white image was made by means of an inversion development mode in the same way as in Examples 1–10. As a result, a large number of dark-spotted defects occurred on the image. In this connection, the liquid coating material for forming the under-coating layer used in Comparative Example 1 was homogeneous enough just after the dispersion, but it yielded aggregate of titatnium oxide as sediment underneath the solution at the 30th day of the pot life. The composition, thus, was so unstable during preservation that the under-coating layer 3 could not be made.

COMPARATIVE EXAMPLE 2

In the same manner as in Example 1, the under-coating layer 3 was provided, provided that the components of the liquid coating material for forming the under-coating layer used in Example 1 were altered as follows. Then, the photoreceptive layer 4 was provided in the same manner as in Example 1 to produce the electrophotographic photoreceptor 1*b* of monolayer type.

Liquid Coating Material for Forming the Under-Coating Layer

| | |
|---|---|
| Titanium oxide (surface-untreated dendritic; titanium oxide content 98%): STR-60N (Product of Ishihara Sangyo Kaisha Ltd.) | 3 weight parts |
| Methanol | 35 weight parts |
| 1,2-Dichloroethane | 65 weight parts |

Using the photoreceptor 1*b* produced as above, a totally white image was made by means of an inversion development mode in the same way as in Examples 1–10. As a result, a large number of dark-spotted defects occurred on the image. In this connection, the liquid coating material for forming the under-coating layer used in Comparative Example 2 produced almost no aggregate of titanium oxide at the 30th day of the pot life. There was no problem on the preservation stability, accordingly. The image generated at the 30th day of the pot life, however, produced a large number of dark-spotted defects thereon, wherein the photoreceptor 1*b* was made in the same manner as in the Comparative Example 2.

COMPARATIVE EXAMPLE 3

The under-coating layer 3 was provided using the same liquid coating material for forming the under-coating layer as used in Comparative Example 1. Then, the photoreceptive layer 4 was provided in the same manner as in Example 2 to produce the electrophotographic photoreceptor 1*a* of function-separating type.

Using the photoreceptor 1*a* produced as above, a totally white image was made by means of an inversion development mode in the same way as in Examples 1–10. As a result, a large number of dark-spotted defects occurred on the image. In this connection, the liquid coating material for forming the under-coating layer used in Comparative Example 3 was homogeneous enough just after the dispersion, but it yielded aggregate of titatnium oxide as sediment underneath the solution at the 30th day of the pot life. The composition, thus, was so unstable during preservation that the under-coating layer 3 could not be made.

COMPARATIVE EXAMPLE 4

The under-coating layer 3 was provided using the same liquid coating material for forming the under-coating layer as used in Comparative Example 2. Then, the photoreceptive layer 4 was provided in the same manner as in Example 2 to produce the electrophotographic photoreceptor 1*a* of function-separating type.

Using the photoreceptor 1*a* produced as above, a totally white image was made by means of an inversion development mode in the same way as in Examples 1–10. As a result, a large number of dark-spotted defects occurred on the image. In this connection, the liquid coating material for forming the under-coating layer used in Comparative Example 4 produced almost no aggregate of titanium oxide at the 30th day of the pot life. There was no problem on the preservation stability, accordingly. The image generated at the 30th day of the pot life, however, produced a large number of dark-spotted defects thereon, wherein the photoreceptor 1*a* was made in the same manner as in the Comparative Example 4.

COMPARATIVE EXAMPLE 5

In the same manner as in Example 1, the under-coating layer 3 was provided, provided that the components of the liquid coating material for forming the under-coating layer as used in Example 1 were altered as follows and the drying was conducted at 120° C. for 20 minutes. Then, the photoreceptive layer 4 was provided in the same manner as in Example 1 to produce the electrophotographic photoreceptor 1*b* of monolayer type.

Liquid Coating Material for Forming the Under-Coating Layer

| | |
|---|---|
| Titanium oxide (surface-untreated granules; titanium oxide content 98%): TTO-55N (Product of Ishihara Sangyo Kaisha Ltd.) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

Using the respective photoreceptor 1*b* produced as above, a totally white image was made by means of an inversion development mode in the same way as in Examples 1–10. As a result, a large number of dark-spotted defects occurred on the image. In this connection, the liquid coating material for forming the under-coating layer used in Comparative Example 5 was homogeneous enough just after the dispersion, but its viscosity was increased at the 30th day of the pot life. The under-coating layer 3 at the 30th day of the pot life, however, yielded uneven coating, wherein the photoreceptor 1*b* was made in the same manner as in the Comparative Example 5. The image generated, further, produced a large number of dark-spotted defects thereon, and the image defects caused by uneven coating were also observed.

COMPARATIVE EXAMPLE 6

The components of the liquid coating material for forming the under-coating layer as used in Comparative Example 3 were altered as follows and the drying was conducted at 120° C. for 20 minutes. Otherwise, the photoreceptive layer 4 was provided in the same manner as in Example 2 to produce the electrophotographic photoreceptor 1*a* of function-separating type.

Liquid Coating Material for Forming the Under-Coating Layer

| | |
|---|---|
| Titanium oxide (surface-untreated dendritic; titanium oxide content 98%): STR-60N (Product of Sakai Chemical Ind. Co., Ltd.) | 3 weight parts |
| Water-soluble polyvinyl acetal resin: KW-1 (Product of Sekisui Chemical Co., Ltd.) | 3 weight parts (solid portion) |
| Methanol | 35 weight parts |
| 1,2-Dichloroethane | 65 weight parts |

Using the photoreceptor 1*a* produced as above, a totally white image was made by means of an inversion development mode in the same way as in Examples 1–10. As a result, a large number of dark-spotted defects occurred on the image. Moreover, the liquid coating material for forming the under-coating layer used in Comparative Example 6 was homogeneous enough just after the dispersion, but its viscosity was increased at the 30th day of the pot life. The under-coating layer 3 at the 30th day of the pot life, however, yielded uneven coating, wherein the photoreceptor 1*a* was made in the same manner as in the Comparative Example 6. The image generated, further, produced a large number of dark-spotted defects thereon, and the image defects caused by uneven coating were also observed.

COMPARATIVE EXAMPLE 7

The components of the liquid coating material for forming the under-coating layer as used in Comparative Example 3 were altered as follows and the drying was conducted at 120° C. for 20 minutes. Then, the photoreceptive layer 4 was provided in the same manner as in Example 2 to produce the electrophotographic photoreceptor 1*a* of function-separating type.

Liquid Coating Material for Forming the Under-Coating Layer

| | |
|---|---|
| Titanium oxide (dendritic; the surface treated with $Fe_2O_3$; titanium oxide content 95%) | 3 weight parts |
| Water-soluble polyvinyl acetal resin: KW-1 (Product of Sekisui Chemical Co., Ltd.) | 3 weight parts (solid portion) |
| Methanol | 35 weight parts |
| 1,2-Dichloroethane | 65 weight parts |

Using the photoreceptor 1*a* produced as above, a totally white image was made by means of an inversion development mode in the same way as in Examples 1–10. As a result, it was found that the electrification and sensitivity of the photoreceptor decreased markedly and the image concentration was poor in gradient. Moreover, a large number of dark-spotted defects were observed. It is noteworthy that the titanium oxide used in Comparative Example 7 was prepared from the surface-untreated dendritic titanium oxide by external addition of 5% $Fe_2O_3$.

COMPARATIVE EXAMPLE 8

The components of the liquid coating material for forming the under-coating layer as used in Comparative Example 3 were altered as follows and the drying was conducted at 120° C. for 20 minutes. Otherwise, the photoreceptive layer 4 was provided in the same manner as in Example 2 to produce the electrophotographic photoreceptor 1*a* of function-separating type.

Liquid Coating Material for Forming the Under-Coating Layer

| | |
|---|---|
| Titanium oxide (dendritic; the surface treated with $Al_2O_3$ (15%) and $ZrO_2$ (15%); titanium oxide content 70%) | 3 weight parts |
| Water-soluble polyvinyl acetal resin: KW-1 (Product of Sekisui Chemical Co., Ltd.) | 3 weight parts (solid portion) |
| Methanol | 35 weight parts |
| 1,2-Dichloroethane | 65 weight parts |

Using the photoreceptor 1*a* produced as above, a totally white image was made by means of an inversion development mode in the same way as in Examples 1–10. As a result, it was found that the sensitivity of the photoreceptor decreased markedly and the image concentration was poor in gradient. Moreover, the liquid coating material for forming the under-coating layer used in Comparative Example 8 was homogeneous enough just after the dispersion, but its viscosity was increased at the 30th day of the pot life. The under-coating layer 3 at the 30th day of the pot life, however, yielded uneven coating, wherein the photoreceptor 1*a* was made in the same manner as in the Comparative Example 8. The image generated, further, produced a large number of dark-spotted defects thereon, and the image defects caused by uneven coating were also observed.

Figure 3:
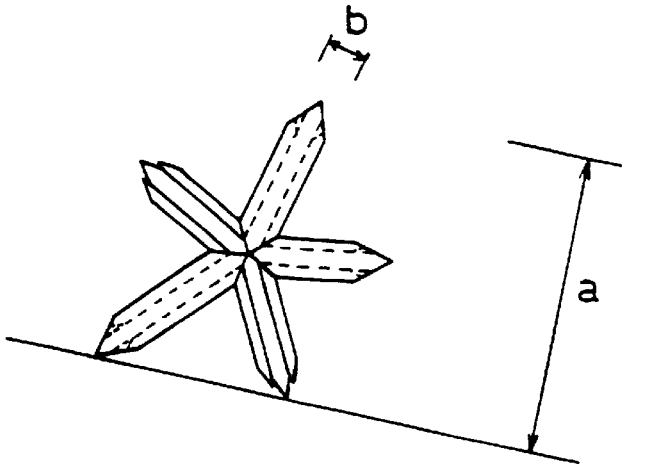
FIG. 3 shows a titanium oxide particle.

From the results of Examples 1–10 and Comparative Examples 1–8, it is found that treatment of the titanium oxide surface with (a) metal oxide(s) and/or (an) organic compound(s) improves the preservation stability of the liquid coating material for forming the under-coating layer to generate a better image character with no image defect. It is also found that the preferred metal oxide used in coating of the titanium oxide surface include $Al_2O_3$ and/or ZrO, $ZrO_2$. It is further found that the preferred titanium oxide is in a form of dendrites as shown in FIG. 3.

EXAMPLE 11

In the same manner as in Example 1, the under-coating layer 3 was provided, provided that the components of the liquid coating material for forming the under-coating layer used in Example 1 were altered as follows. Then, the photoreceptive layer 4 was provided in the same manner as in Example 2 to produce the electrophotographic photoreceptor 1*a* of function-separating type.

Liquid Coating Material for Forming the Under-Coating Layer

| | |
|---|---|
| Titanium oxide (dendritic rutile-type; the surface treated with $Al_2O_3$ and $ZrO_2$; titanium content 85%): TTO-D-1 (Product of Ishihara Sangyo Kaisha Ltd.) | 3 weight parts |
| Alcohol-soluble nylon resin: CM8000 (Product of Toray Industries Inc.) | 3 weight parts |
| Methanol | 35 weight parts |
| 1,2-Dichloroethane | 65 weight parts |

EXAMPLE 12

In the same manner as in Example 1, the under-coating layer 3 was provided, provided that the components of the liquid coating material for forming the under-coating layer used in Example 1 were altered as follows. Then, the photoreceptive layer 4 was provided in the same manner as in Example 2 to produce the electrophotographic photoreceptor 1*a* of function-separating type.

Liquid Coating Material for Forming the Under-Coating Layer

| | |
|---|---|
| Titanium oxide (dendritic rutile-type; the surface treated with $Al_2O_3$ and $ZrO_2$; titanium content 85%): TTO-D-1 (Product of Ishihara Sangyo Kaisha Ltd.) | 3 weight parts |
| Alcohol-soluble nylon resin: CM8000 (Product of Toray Industries Inc.) | 3 weight parts |
| γ-(2-Aminoethyl) aminopropylmethyldimethoxysilane | 0.15 weight part |
| Methanol | 35 weight parts |
| 1,2-Dichloroethane | 65 weight parts |

EXAMPLES 13–16

In the same manner as in Example 1, the under-coating layer 3 was provided, provided that the silane-coupling agent employed in the liquid coating material for forming the under-coating layer used in Example 12 was altered as follows, respectively in Examples 13–16. Then, the photoreceptive layer 4 was provided in the same manner as in Example 2 to produce the electrophotographic photoreceptor 1*a* of function-separating type.

EXAMPLE 13

| | |
|---|---|
| γ-(2-Aminoethyl) aminopropylmethyldimethoxysilane | 0.6 weight part |
| (Example 14) Phenyltrichlorosilane | 0.15 weight part |
| (Example 15) Bis(dioctylpyrophosphate) | 0.15 weight part |
| (Example 16) Acetoalkoxyaluminium diisopropylate | 0.15 weight part |

EXAMPLES 17 AND 18

In the same manner as in Example 11, the under-coating layer 3 was provided, provided that the adhesive resin employed in the liquid coating material for forming the under-coating layer used in Example 11 was altered to the following resins, respectively in Examples 17 and 18. Then, the photoreceptive layer 4 was provided in the same manner as in Example 2 to produce the electrophotographic photoreceptor 1*a* of function-separating type.

Example 17

N-Methoxymethylated nylon resin: EF-30T (Product of Teikoku Chemical Ind. Co., Ltd.)

Example 18

Alcohol-soluble nylon resin: VM171 (Product of Daicel-Huels Ltd.)

EXAMPLE 19

In the same manner as in Example 11, the under-coating layer 3 was provided, provided that the titanium oxide employed in the liquid coating material for forming the under-coating layer used in Example 11 was altered to the following ones. Then, the photoreceptive layer 4 was provided in the same manner as in Example 2 to produce the electrophotographic photoreceptor 1*a* of function-separating type.

| | |
|---|---|
| Titaniuin oxide (dendritic rutile-type; the surface treated with $Al_2O_3$ and $ZrO_2$; titanium content 85%): TTO-D-1 (Product of Ishihara Sangyo Kaisha Ltd.) | 1.5 weight parts |
| Titanium oxide (dendritic rutile-type; the surface treated with $Al_2O_3$ and $SiO_2$; titanium content 91%): STR-60S (Product of Sakai Chemical Ind. Co., Ltd.) | 1.5 weight parts |

EXAMPLE 20

In the same manner as in Example 11, the under-coating layer 3 was provided, provided that the titanium oxide employed in the liquid coating material for forming the under-coating layer used in Example 11 was altered to the following ones. Then, the photoreceptive layer 4 was provided in the same manner as in Example 2 to produce the electrophotographic photoreceptor 1*a* of function-separating type.

| | |
|---|---|
| Titanium oxide (dendritic rutile-type; the surface treated with $Al_2O_3$ and $ZrO_2$; titanium content 85%): TTO-D-1 (Product of Ishihara Sangyo Kaisha Ltd.) | 2 weight parts |
| Surface-treated granular anatase type (titanium content 98%): TA-300 (Fuji Titanium Industry Co., Ltd.) | 1 weight part |

Using the respective photoreceptors 1*a* produced in Examples 11–20 as mentioned above, a totally white image was made by means of an inversion development mode in the same manner as in Examples 1–10. There was no defective image in any of photoreceptors 1*a* in Examples 11–20 yielding better images. Moreover, no aggregate of titanium oxide occurred at the 30th day in the pot life, and there was no problem on the preservation stability of the liquid coating materials, accordingly, except that of Example 19. In Example 19, however, occurrence of some aggregates of titanium oxide as sediment was observed. On the other hand, the respective photoreceptors 1*a* were made at the 30th day of the pot-life test in same manner as mentioned above. The resulting images were better with no defect as in the early stage of the pot-life test, except those of Examples 19 and 20. In Examples 19 and 20, some dark-spotted defects occurred.

COMPARATIVE EXAMPLE 9

In the same manner as in Example 11, the under-coating layer 3 was provided, provided that the titanium oxide employed in the liquid coating material for forming the under-coating layer used in Example 11 was altered to the following one. Then, the photoreceptive layer 4 was provided in the same manner as in Example 2 to produce the electrophotographic photoreceptor 1*a* of function-separating type.

| | |
|---|---|
| Titanium oxide (dendritic; the surface treated with $SnO_2$ Sb dope; conductive treatment): FT-1000 (Product of Ishihara Sangyo Kaisha Ltd.) | 3 weight parts |

Using the photoreceptor 1*a* produced in Comparative Example 9 as mentioned above, a totally white image was made by means of an inversion development mode in the same manner as in Examples 1–10. As a result, it afforded a bad image with many fogs and poor in electrically charged property.

From the results of Examples 11–20 and Comparative Example 9, it is found that the surface treatment of titanium oxide with (a) metal oxide(s) and/or (an) organic compound (s) improves the preservation stability of the liquid coating material for forming the under-coating layer to generate a better image character with no image defect. Moreover, it is also found that the preferred metal oxide used in coating of the titanium oxide surface include $Al_2O_3$ and/or ZrO, $ZrO_2$. When the titanium oxide to which was applied conductive treatment was used, electrification of the photoreceptor is found to decrease markedly. The preferred form of titanium oxide is found to be dendritic. Furthermore, it is also found that the use of polyamide resin as an adhesive resin improves the preservation stability of the liquid coating material for forming the under-coating layer, and that the photoreceptor produced from said composition even after a long lapse of time generates a better image character.

EXAMPLE 21

In the same manner as in Example 1, the liquid coating material for forming the under-coating layer was prepared, wherein the components of the liquid coating material used in Example 1 were altered as follows. Then, using a dip coating apparatus as shown in FIG. 2, an aluminum cylinder of 65 mm in diameter and 348 mm in length was immersed into the liquid coating material to form a film on the cylinder, which was dried to yield the under-coating layer 3 of 0.05 $\mu$m in dry thickness.

Subsequently, coating solutions for forming the photoreceptive layer were prepared in the same manner as in Example 2, into which the cylinder was immersed in order to form a charge generation layer 5 and a charge transport layer 6. The cylinder was dried at 80° C. under hot air for 1 hour to yield the photoreceptive layer 4 of 27 $\mu$m in dry thickness. Thus, the electrophotographic photoreceptor 1*a* of function-separating type was produced.

Liquid Coating Material for Forming the Under-Coating Layer

| | |
|---|---|
| Titanium oxide (dendritic rutile-type; the surface treated with $Al_2O_3$ and $ZrO_2$; titanium content 85%): TTO-D-1 (Product of Ishihara Sangyo Kaisha Ltd | 3 weight parts |
| Alcohol-soluble nylon resin: CM8000 (Product of Toray Industries Inc.) | 3 weight parts |
| Methanol | 35 weight parts |
| 1,2-Dichloroethane | 65 weight parts |

EXAMPLES 22–24

In the same manner as in Example 21, the under-coating layer 3 was provided, provided that the film prepared with the liquid coating material for forming the under-coating layer used in Example 21 was fixed to 1, 5 or 10 $\mu$m in dry thickness. Then, the photoreceptive layer 4 was provided in the same manner as in Example 21 to produce the electrophotographic photoreceptor 1*a* of function-separating type.

| | | |
|---|---|---|
| (Example 22) | Thickness of the under-coating layer 3 | 1 μm |
| (Example 23) | Thickness of the under-coating layer 3 | 5 μm |
| (Example 24) | Thickness of the under-coating layer 3 | 10 μm |

The respective photoreceptors 1*a* produced in Examples 21–24 as above were installed in a digital copying machine AR-5030 (Sharp Co., Ltd.), and the totally white image was made by means of an inversion development mode. As a result, there was no defective image in any cases of Examples 21–24 yielding better images.

COMPARATIVE EXAMPLES 10 AND 11

In the same manner as in Example 21, the under-coating layer 3 was provided, provided that the film prepared with the liquid coating material for forming the under-coating layer used in Example 21 was fixed to 0.01 or 15 μm in dry thickness. Then, the photoreceptive layer 4 was provided in the same manner as in Example 21 to produce the electrophotographic photoreceptor 1*a* of function-separating type.

| | | |
|---|---|---|
| (Comp.Ex. 10) | Thickness of the under-coating layer 3 | 0.01 μm |
| (Comp.Ex. 11) | Thickness of the under-coating layer 3 | 15 μm |

The respective photoreceptors 1*a* produced in Comparative Examples 10 and 11 as above were installed in a digital copying machine AR-5030 (Sharp Co., Ltd.), and the totally white image was made by means of an inversion development mode. As a result, there was no defective image in any cases of Comparative Examples 10 and 11 yielding better images. Moreover, a copying durability test was carried out on 30,000 sheets under an environment at a low temperature of 10° C. and low humidity of 15% RH to give the result as shown in Table 1.

TABLE 1

| | Under-coating layer Thickness (μm) | Under-coating layer Resin | Initial Potential in dark $V_o$(-V) | Initial Potential in light $V_L$(-V) | After 30,000 Sheet copying Potential in dark $V_o$(-V) | After 30,000 Sheet copying Potential in light $V_L$(-V) |
|---|---|---|---|---|---|---|
| Exa.21 | 0.05 | CM80000 | 600 | 100 | 600 | 115 |
| Exa.22 | 1.0 | CM80000 | 610 | 110 | 590 | 130 |
| Exa.23 | 5 | CM80000 | 630 | 130 | 600 | 170 |
| Exa.24 | 10 | CM80000 | 645 | 140 | 610 | 180 |
| Cm.Ex.10 | 0.01 | CM80000 | 590 | 100 | 605 | 200 |
| Cm.Ex.11 | 15 | CM80000 | 660 | 200 | 610 | 320 |

From Table 1, the sensitivity is found to be stable in a range of 0.05 μm–10 μm in thickness of the under-coating layer 3. In addition, in the image characteristics after performing the copying durability test on 30,000 sheets, Examples 21–24 afforded good images similar to the initial ones, but Comparative Example 10 yielded a large number of dark-spotted defects after the test.

EXAMPLES 25–28

In the same manner as in Example 21, the under-coating layer 3 of 1.0 μm in dry thickness was provided using the liquid coating material for forming the under-coating layer as used in Example 21, provided that the ratio of titanium oxide (P) to polyamide resin (R) was fixed to 10/90, 35/65, 70/30 and 99/1 in Examples 25–28, respectively. Then, the photoreceptive layer 4 was provided in the same manner as in Example 21 to produce the electrophotographic photoreceptor 1*a* of function-separating type.

Example 25

P/R=10/90

Example 26

P/R=35/65

Example 27

P/R=70/30

Example 28

P/R=99/1

The respective photoreceptors 1*a* produced in Examples 25–28 as above were installed in a digital copying machine AR-5030 (Sharp Co., Ltd.), and the totally white image was made by means of an inversion development mode. As a result, there was no defective image in any cases of Examples 25–28 yielding better images. Moreover, a copying durability test was carried out on 30,000 sheets under an environment at a low temperature of 10° C. and low humidity of 15% RH to give the result as shown in Table 2.

TABLE 2

| | Under-coating layer P/R | Under-coating layer Resin | Initial Potential in dark $V_o$(-V) | Initial Potential in light $V_L$(-V) | After 30,000 Sheet copying Potential in dark $V_o$(-V) | After 30,000 Sheet copying Potential in light $V_L$(-V) |
|---|---|---|---|---|---|---|
| Exa.25 | 10/90 | CM80000 | 630 | 120 | 600 | 160 |
| Exa.26 | 35/65 | CM80000 | 620 | 110 | 590 | 130 |

TABLE 2-continued

| | Under-coating layer P/R | Under-coating layer Resin | Initial Potential in dark $V_o$(-V) | Initial Potential in light $V_L$(-V) | After 30,000 Sheet copying Potential in dark $V_o$(-V) | After 30,000 Sheet copying Potential in light $V_L$(-V) |
|---|---|---|---|---|---|---|
| Exa.27 | 70/30 | CM80000 | 610 | 110 | 600 | 120 |
| Exa.28 | 99/1 | CM80000 | 590 | 100 | 610 | 110 |

From Table 2, the sensitivity is found to be stable in a range of 10%–99% by weight of titanium oxide content in the under-coating layer. In addition, in the image characteristics after performing the copying durability test on 30,000 sheets, Examples 25–27 afforded good images similar to the initial ones, but Example 28 yielded a slight number of dark-spotted defects after the test.

EXAMPLES 29–34

In the same manner as in Example 21, the under-coating layer 3 was provided using the liquid coating material for forming the under-coating layer used in Example 22, provided that the composition of the solvent used was fixed as mentioned below. Then, the photoreceptive layer 4 was provided in the same manner as in Example 22 to produce the electrophotographic photoreceptor 1*a* of function-separating type. The figures corresponding to the respective solvents are indicated by weight part.

Example 29

Methyl alcohol/1,2-dichloropropane=43.46/38.54

Example 30

Methyl alcohol/chloroform=10.33/71.67

Example 31

Methyl alcohol/tetrahydrofuran=25.50/56.50

Example 32

Methyl alcohol/toluene=58.30/23.70

Example 33

Ethyl alcohol/chloroform=30/52

Example 34

Ethyl alcohol/dichloromethane=70/12

The photoreceptors 1*a* produced in Examples 29–34 as above were visually examined as to whether there was any uneven coating in either case in which the under-coating layer 3 alone was formed or the photoreceptive layer 4 was also formed. As a result, no uneven coating was observed in any solvents used. In addition, a better image character with no image defect was obtained. Moreover, in the similar coating film formed and examined at the 30th day of the pot life, a good film character and image character similar to the initial ones were obtained.

COMPARATIVE EXAMPLE 12

In the same manner as in Example 22, the under-coating layer 3 was provided, provided that 82 weight parts of methyl alcohol was used as a solvent in the liquid coating material for forming the under-coating layer as used in Example 22. Then, the photoreceptive layer 4 was provided in the same manner as in Example 21 to produce the electrophotographic photoreceptor 1*a* of function-separating type.

The photoreceptors 1*a* produced in Comparative Example 12 as above were visually examined as to whether there was any uneven coating in either case in which the under-coating layer 3 alone was formed or the photoreceptive layer 4 was also formed. In coating the under-coating layer 3, falling in drops was observed and a rough-grained and uneven image was generated. Moreover, a similar coating film was made at the 30th day of the pot life and the image character was examined. As a result, the falling in drops in the under-coating layer 3 grew larger and rough dark-spotted defects occurred.

EXAMPLE 35

An aluminum cylinder of 80 mm in diameter and 348 mm in length was immersed in the liquid coating material for forming the under-coating layer to apply it on the cylinder surface to make the under-coating layer 3 of 1.0 $\mu$m in dry thickness. Then, the following components were dispersed with a paint shaker for 8 hours to prepare a coating suspension for forming the charge generation layer.

Coating Suspension for Forming the Charge Generation Layer

| | |
|---|---|
| Bis-azo pigment of the following structural formula: [Structural formula 4] | 2 weight parts |

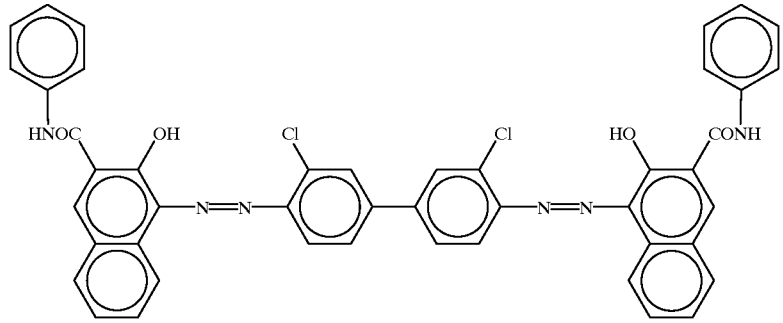

| | |
|---|---|
| Vinyl chloride-vinyl acetate-maleic acid copolymer resin: SOLBIN M (Product of Nisshin Chemical Co., Ltd.) | 2 weight parts |
| 1,2-Dimethoxyethane | 100 weight parts |

The aluminum cylinder having the under-coating layer 3 was immersed into the coating suspension for forming the charge generation layer to form the charge generation layer 5 of 1.0 μm in dry thickness. Then, a mixture of the following components was stirred to give a coating solution for forming the charge transport layer. The aluminum cylinder on which the charge generation layer 5 was formed was then immersed into the solution, and the layer formed was dried under hot air at 80° C. for 1 hour. Thus, an electrophotographic photoreceptor 1*a* of function-separating type having the charge transport layer 6 of 20 μm in dry thickness was produced.

Coating Solution for Forming the Charge Transport Layer

| | |
|---|---|
| Hydrazone-type compound of the following structural formula: [Structural formula 5] | 8 weight parts |

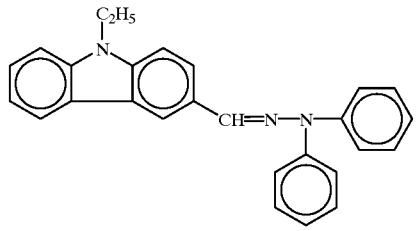

| | |
|---|---|
| Polycarbonate resin: K1300 (Product of Teijin Chemical Ltd.) | 10 weight parts |
| Silicone oil: KF50 (Product of Shin-Etsu Chemical Co., Ltd.) | 0.002 weight part |
| Dichloromethane | 120 weight parts |

The respective photoreceptors 1*a* produced in Example 35 as above were installed in an image-forming machine SF-8870 (Sharp Co., Ltd.) to form an image. As a result, a good image character a with no image defect was obtained since the photoreceptive layer 4 had no coating unevenness.

As shown in the above examples 1–35, the liquid coating material for forming the under-coating layer which contains dendritic titatium oxide particles of which the surface is coated with a metal oxide and/or organic compound is superior in dispersibility and preservation stability. In addition, since injection of the electric charge from the conductive support 2 is inhibited, a very good image character can be obtained even when it is installed on an image-forming apparatus by inversion development processing. Moreover, titanium oxide is adapted well to an adhesive resin to decrease cohesion between the titanium oxide particles. Using a mixture of a lower alcohol and another organic solvent or an azeotropic mixture of them, a very stably dispersible liquid coating material for forming the under-coating layer can be obtained, which is stable for a long period of time and forms a uniform under-coating layer 3 to afford a better image character. Since dendritic titanium oxide is used, electrophotographic photoreceptors 1*a* and 1*b* which have an environmental characteristic, which do not cause deterioration of electric and image characteristics due to repeated use over a long term, and which have a very stable character can be obtained.

As mentioned above, the liquid coating material for forming the under-coating layer is superior in dispersibility and stability and affords a uniform under-coating layer 3 on the conductive support 2 by means of an immersion-coating method. Thus, a highly sensitive and long-life electrophotographic photoreceptors 1*a* and 1*b* which afford a good image character, a method for producing them, and an image-forming apparatus using them can be provided.

EXAMPLE 36

The following components were dispersed with a paint shaker for 10 hours to prepare a liquid coating material for forming the under-coating layer.

Liquid Coating Material for Forming the Under-Coating Layer

| | |
|---|---|
| Titanium oxide (needle-like, the surface treated with ZnO; the titanium oxide content: 90%) | 3 weight parts |
| Methanol | 35 weight parts |
| 1,2-Dichloroethane | 65 weight parts |

As a conductive support 2, an aluminum conductive support of 100 μm in thickness was employed, on which the liquid coating material for forming the under-coating layer was applied with a Baker applicator and dried at 110° C. under hot air for 10 minutes to provide the under-coating layer 3 of 1.0 μm in thickness. The titanium oxide used in Example 36 was prepared by treating the surface-intact titanium oxide with 10% ZnO.

Next, the following components were dispersed with a ball mill for 12 hours to prepare a coating suspension for forming the photoreceptive layer. Said suspension was applied on the under-coating layer 3 with a Baker applicator and dried at 100° C. under hot air for 1 hour. Thus, the photoreceptive layer 4 of 20 μm in thickness was provided to afford an electrophotographic photoreceptor 1*b* of mono-layer type.

Coating Suspension for Forming the Photoreceptive Layer

| | |
|---|---|
| Non-metallic phthalocyanine of τ-type: Liophoton TPA-891 (Product of Toyo Ink Mfg. Co., Ltd.) | 17.1 weight parts |
| Polycarbonate resin: Z-400 (Mitsubishi Gas Chemical Co., Ltd.) | 17.1 weight parts |
| Hydrazone-type compound of the following structural formula: [Structural formula 6] | 17.1 weight parts |

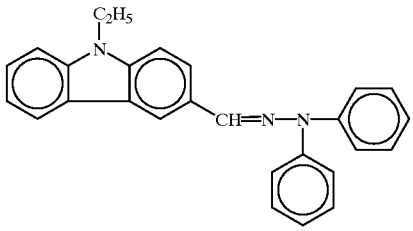

-continued

| | |
|---|---|
| Diphenoquinone compound of the following structural formula: [Structural formula 7] | 17.1 weight parts |

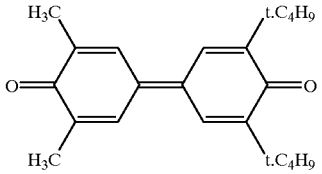

| | |
|---|---|
| Tetrahydrofuran | 100 weight parts |

EXAMPLE 37

Using the liquid coating material for forming the under-coating layer used in Example 36, the under-coating layer 3 was formed in the same manner. Then, the following components were dispersed with a ball mill for 12 hours to prepare a coating suspension for forming the charge generation layer. The coating suspension was applied on the under-coating layer 3 with a Baker applicator and dried at 120° C. under hot air for 10 minutes to generate the charge generation layer 5 of 0.8 μm in dry thickness.

Coating Suspension for Forming the Charge Generation Layer

| | |
|---|---|
| Non-metallic phthalocyanine of τ-Type: Liophoton TPA-891 (Product of Toyo Ink Mfg. Co., Ltd.) | 2 weight parts |
| Vinyl chloride-vinyl acetate-maleic acid copolymer resin: SOLBIN M (Product of Nisshin Chemical Co., Ltd.) | 2 weight parts |
| Methyl ethyl ketone | 100 weight parts |

In addition, the following components were mixed, stirred and dissolved to prepare a coating solution for forming the charge transport layer. The coating solution was applied on the charge generation layer 5 with a Baker applicator and dried at 80° C. under hot air for 1 hour to generate the charge transport layer 6 of 20 μm in dry thickness. Thus, the electrophotographic photoreceptor 1*a* of function-separating type was produced.

Coating Solution for Forming the Charge Transport Layer

| | |
|---|---|
| Hydrazone-type compound of the following structural formula: [Structural formula 8] | 8 weight parts |

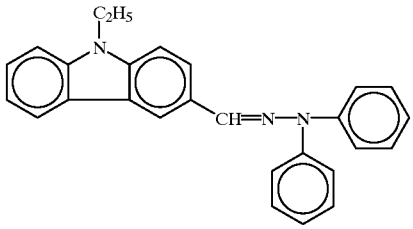

| | |
|---|---|
| Polycarbonate resin: K1300 (Product of Teijin Chemical Ltd.) | 10 weight parts |
| Silicone oil: KF50 (Product of Shin-Etsu Chemical Co., Ltd.) | 0.002 weight part |
| Dichloromethane | 120 weight parts |

EXAMPLE 38

In the same manner as in Example 36, the under-coating layer 3 was provided, provided that the components of the liquid coating material for forming the under-coating layer used in Example 36 was altered as follows. Thus, the photoreceptive layer 4 was provided in the same manner as in Example 37 to produce the electrophotographic photoreceptor 1*a* of function-separating type.

Liquid Coating Material for Forming the Under-Coating Layer

| | |
|---|---|
| Titanium oxide (needle-like, the surface treated with $Al_2O_3$; the titanium oxide content: 90%) | 3 weight parts |
| Methanol | 35 weight parts |
| 1,2-Dichloroethane | 65 weight parts |

EXAMPLE 39

In the same manner as in Example 36, the under-coating layer 3 was provided, provided that the components of the liquid coating material for forming the under-coating layer used in Example 36 was altered as follows. Thus, the photoreceptive layer 4 was provided in the same manner as in Example 37 to produce the electrophotographic photoreceptor 1*a* of function-separating type.

Liquid Coating Material for Forming the Under-Coating Layer

| | |
|---|---|
| Titanium oxide (needle-like, the surface treated with aminopropyltrimethoxysilane; the titaniuin oxide content: 90%) | 3 weight parts |
| Methanol | 35 weight parts |
| 1,2-Dichloroethane | 65 weight parts |

EXAMPLE 40

In the same manner as in Example 36, the under-coating layer 3 was provided, provided that the components of the liquid coating material for forming the under-coating layer used in Example 36 were altered as follows and the drying was carried out at 120° C. for 20 minutes. Thus, the photoreceptive layer 4 was provided in the same manner as in Example 36 to produce the electrophotographic photoreceptor 1*b* of monolayer type.

Liquid Coating Material for Forming the Under-Coating Layer

| | |
|---|---|
| Titanium oxide (needle-like, the surface treated with ZnO; the titanium oxide content: 90%) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

EXAMPLE 41

In the same manner as in Example 40, the under-coating layer 3 was provided using the liquid coating material for forming the under-coating layer used in Example 40. Then, the photoreceptive layer 4 was provided in the same manner as in Example 37 to produce the electrophotographic photoreceptor 1*a* of function-separating type.

EXAMPLES 42–45

In the same manner as in Example 40, the under-coating layer 3 was provided, provided that the components of the liquid coating material for forming the under-coating layer used in Example 40 were altered to those as mentioned in the following respective examples 42–45. Thus, the photoreceptive layer 4 was provided in the same manner as in Example 37 to produce the electrophotographic photoreceptor 1*a* of function-separating type.

Liquid Coating Material for Forming the Under-Coating Layer (Example 42)

| | |
|---|---|
| Titanium oxide (needle-like, the surface treated with $Al_2O_3$; the titanium oxide content: 95%) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

Liquid Coating Material for Forming the Under-Coating Layer (Example 43)

| | |
|---|---|
| Titanium oxide (needle-like, the surface treated with $ZrO_2$; the titanium oxide content: 95%) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

Liquid Coating Material for Forming the Under-Coating Layer (Example 44)

| | |
|---|---|
| Titanium oxide (needle-like, the surface treated with $Al_2O_3$ (5%) and $ZrO_2$ (5%); the titanium oxide content: 90%) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

Liquid Coating Material for Forming the Under-Coating Layer (Example 45)

| | |
|---|---|
| Titanium oxide (needle-like, the surface treated with $Al_2O_3$ (10%) and $ZrO_2$ (10%); the titanium oxide content: 80%) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

The respective photoreceptors 1*a* and 1*b* produced as in Examples 36–45 were put around an aluminum cylinder of a remodeled digital copying machine of AR-5030 (Sharp Co., Ltd.), on which a totally white image was made by means of an inversion development mode. There was no defective image in any cases of Examples 36–45 yielding better images. In the liquid coating materials of Examples 36–39, however, occurrence of some aggregates of titanium oxide as sediment was slightly observed underneath of the solution in a pot-life test after preservation for 30 days at room temperature in a dark place. At the 30th day of the pot life, the respective photoreceptors 1*a* and 1*b* were made in the same way as mentioned in Examples 36–45 to form images thereon. As a result, slight dark-spotted defects were observed on the image. Table 3 shows these results together.

TABLE 3

| Example | Totally white image at the early stage | 30 Days after the pot life | Totally white image after the pot life |
|---|---|---|---|
| 36 | ○ | Δ | Δ |
| 37 | ○ | Δ | Δ |
| 38 | ○ | Δ | Δ |
| 39 | ○ | Δ | Δ |
| 40 | ○ | ○ | Δ |
| 41 | ○ | ○ | Δ |
| 42 | ○ | ○ | Δ |
| 43 | ○ | ○ | Δ |
| 44 | ○ | ○ | Δ |
| 45 | ○ | ○ | Δ |

TABLE 3-continued

| Example | Totally white image at the early stage | 30 Days after the pot life | Totally white image after the pot life |
|---|---|---|---|
| | (Totally white image at the early stage) ○: no dark-spotted defects Δ: slightly dark-spotted defects X: many dark-spotted defects | (30 Days after the pot life) ○: no cohesion and deposition Δ: somewhat deposition X: much aggregate and deposition | (Totally white image after the pot life) ○: no dark-spotted defects Δ: slightly dark-spotted defects X: many dark-spotted defects |

COMPARATIVE EXAMPLE 13

In the same manner as in Example 36, the under-coating layer 3 was provided, provided that the components of the liquid coating material for forming the under-coating layer used in Example 36 were altered as follows. Thus, the photoreceptive layer 4 was provided in the same manner as in Example 36 to produce the electrophotographic photoreceptor 1*b* of monolayer type.

Liquid Coating material for Forming the Under-Coating Layer

| | |
|---|---|
| Titanium oxide (surface-untreated particles; titanium oxide content 98%): TTO-55N (Product of Ishihara Sangyo Kaisha Ltd.) | 3 weight parts |
| Methanol | 35 weight parts |
| 1,2-Dichloroethane | 65 weight parts |

Using the photoreceptor 1*b* produced in Comparative Example 13, a totally white image was made by means of an inversion development mode in the same way as in Examples 36–45. As a result, a large number of dark-spotted defects occurred on the image. In this connection, the liquid coating material for forming the under-coating layer was homogeneous enough just after the dispersion, but it yielded aggregate of titanium oxide as sediment underneath the solution at the 30th day of the pot life. The coating material, thus, was so unstable during preservation that the under-coating layer 3 could not be made.

COMPARATIVE EXAMPLE 14

In the same manner as in Example 36, the under-coating layer 3 was provided, provided that the components of the liquid coating material for forming the under-coating layer used in Example 36 were altered as follows. Thus, the photoreceptive layer 4 was provided in the same manner as in Example 36 to produce the electrophotographic photoreceptor 1*b* of monolayer type.

Liquid Coating Material for Forming the Under-Coating Layer

| | |
|---|---|
| Titanium oxide (surface-untreated needle-like; titanium oxide content 98%): STR-60N (Product of Sakai Chemical Ind. Co., Ltd.) | 3 weight parts |
| Methanol | 35 weight parts |
| 1,2-Dichloroethane | 65 weight parts |

Using the photoreceptor 1*b* produced in Comparative Example 14 as above, a totally white image was made by means of an inversion development mode in the same way as in Examples 36–45. As a result, a large number of dark-spotted defects occurred on the image. The liquid coating material for forming the under-coating layer, however, yielded almost no aggregate of titanium oxide at the 30th day of the pot life, and there was no problem as to preservation stability of the liquid coating material. At the 30th day of the pot life, a photoreceptor 1*b* was produced in the same manner as in Comparative Example 14 to form an image, which yielded, however, a large number of dark-spotted defects on the image.

COMPARATIVE EXAMPLE 15

Using the liquid coating material for forming the under-coating layer used in Comparative Example 13, the under-coating layer 3 was provided. Then, the photoreceptive layer 4 was provided in the same manner as in Example 37 to produce the electrophotographic photoreceptor 1*a* of function-separating type.

Using the photoreceptor 1*a* produced in Comparative Example 15 as above, a totally white image was made by means of an inversion development mode in the same way as in Examples 36–45. As a result, a large number of dark-spotted defects occurred on the image. In this connection, the liquid coating material for forming the under-coating layer was homogeneous enough just after the dispersion, but it yielded aggregate of titatnium oxide as sediment underneath the solution at the 30th day of the pot life. The coating material, thus, was so unstable during preservation that the under-coating layer 3 could not be made.

COMPARATIVE EXAMPLE 16

Using the liquid coating material for forming the under-coating layer used in Comparative Example 14, the under-coating layer 3 was provided. Then, the photoreceptive layer 4 was provided in the same manner as in Example 37 to produce the electrophotographic photoreceptor 1*a* of function-separating type.

Using the photoreceptor 1*a* produced in Comparative Example 16 as above, a totally white image was made by means of an inversion development mode in the same way as in Examples 36–45. As a result, a large number of dark-spotted defects occurred on the image. The liquid coating material for forming the under-coating layer, however, yielded almost no aggregate of titanium oxide at the 30th day of the pot life, and there was no problem as to preservation stability of the liquid coating material. At the 30th day of the pot life, a photoreceptor 1*a* was produced in the same manner as in Comparative Example 16 to form an image, which yielded, however, a large number of dark-spotted defects on the image.

COMPARATIVE EXAMPLE 17

In the same manner as in Example 36, the under-coating layer 3 was provided, provided that the components of the liquid coating material for forming the under-coating layer used in Example 36 were altered as follows and the drying was carried out at 120° C. for 20 minutes. Thus, the photoreceptive layer 4 was provided in the same manner as in Example 36 to produce the electrophotographic photoreceptor 1*a* of monolayer type.

Liquid Coating Material for Forming the Under-Coating Layer

| | |
|---|---|
| Titanium oxide (surface-untreated particles; titanium oxide content 98%): TTO-55N (Product of Ishihara Sangyo Kaisha Ltd.) | 3 weight parts |
| Water-soluble polyvinyl acetal resin: KW-1 (Product of Sekisui Chemical Co., Ltd.) | 3 weight parts (solid portion) |
| Methanol | 70 weight parts |
| Water | 30 weight parts |

Using the photoreceptor 1*a* produced in Comparative Example 17 as above, a totally white image was made by means of an inversion development mode in the same way as in Examples 36–45. As a result, a large number of dark-spotted defects occurred on the image. In this connection, the liquid coating material for forming the under-coating layer was homogeneous enough just after the dispersion, but its viscosity was increased at the 30th day of the pot life. The under-coating layer 3 at the 30th day of the pot life, however, yielded uneven coating, wherein the photoreceptor 1*a* was made in the same manner as in the Comparative Example 17. The image generated, further, produced a large number of dark-spotted defects thereon, and the image defects caused by uneven coating were also observed.

COMPARATIVE EXAMPLE 18

In the same manner as in Example 37, the under-coating layer 3 was provided, provided that the components of the liquid coating material for forming the under-coating layer used in Comparative Example 15 were altered as follows and the drying was carried out at 120° C. for 20 minutes. Thus, the photoreceptive layer 4 was provided in the same manner as in Example 37 to produce the electrophotographic photoreceptor la of function-separating type.

Liquid Coating Material for Forming the Under-Coating Layer

| | |
|---|---|
| Titanium oxide (surface-untreated needle-like; titanium oxide content 98%): STR-60N (Product of Sakai Chemical Ind. Co., Ltd.) | 3 weight parts |
| Water-soluble polyvinyl acetal resin: KW-1 (Product of Sekisui Chemical Co., Ltd.) | 3 weight parts (solid portion) |
| Methanol | 35 weight parts |
| 1,2-Dichloroethane | 65 weight parts |

Using the photoreceptor 1*a* produced in Comparative Example 18 as above, a totally white image was made by means of an inversion development mode in the same way as in Examples 36–45. As a result, a large number of dark-spotted defects occurred on the image. In this connection, the liquid coating material for forming the under-coating layer was homogeneous enough just after the dispersion, but its viscosity was increased at the 30th day of the pot life. The under-coating layer 3 at the 30th day of the pot life, however, yielded uneven coating, wherein the photoreceptor 1*a* was made in the same manner as in the Comparative Example 18. The image generated further, produced a large number of dark-spotted defects thereon, and the image defects caused by uneven coating were also observed.

COMPARATIVE EXAMPLE 19

In the same manner as in Example 37, the under-coating layer 3 was provided, provided that the components of the liquid coating material for forming the under-coating layer used in Comparative Example 15 were altered as follows and the drying was carried out at 120° C. for 20 minutes. Then, the photoreceptive layer 4 was provided in the same manner as in Example 37 to produce the electrophotographic photoreceptor 1*a* of function-separating type.

Liquid Coating Material for Forming the Under-Coating Layer

| | |
|---|---|
| Titanium oxide (needle-like, the surface treated with $Fe_2O_3$; titanium oxide content 95%) | 3 weight parts |
| Water-soluble polyvinyl acetal resin: KW-1 (Product of Sekisui Chemical Co., Ltd.) | 3 weight parts (solid portion) |
| Methanol | 35 weight parts |
| 1,2-Dichloroethane | 65 weight parts |

Using the photoreceptor 1*a* produced in Comparative Example 19 as above, a totally white image was made by means of an inversion development mode in the same way as in Examples 36–45. As a result, it was found that electrification and sensitivity of the photoreceptor 1*a* greatly decreased to give a poor gradient of image concentration. Moreover, a large number of dark-spotted defects were observed. In addition, at the 30th day of the pot life, the liquid coating material for forming the under-coating layer yielded slight aggregate, and a large number of dark-spotted defects were observed.

COMPARATIVE EXAMPLE 20

In the same manner as in Example 37, the under-coating layer 3 was provided, provided that the components of the liquid coating material for forming the under-coating layer used in Comparative Example 15 were altered as follows and the drying was carried out at 120° C. for 20 minutes. Then, the photoreceptive layer 4 was provided in the same manner as in Example 37 to produce the electrophotographic photoreceptor 1*a*of function-separating type.

Liquid Coating Material for Forming the Under-Coating Layer

| | |
|---|---|
| Titanium oxide (needle-like, the surface treated with $Al_2O_3$ (15%) and $ZrO_3$ (15%); titanium oxide content 70%) | 3 weight parts |
| Water-soluble polyvinyl acetal resin: KW-1 (Product of Sekisui Chemical Co., Ltd.) | 3 weight parts (solid portion) |
| Methanol | 35 weight parts |
| 1,2-Dichloroethane | 65 weight parts |

Using the photoreceptor 1*a* produced in Comparative Example 20 as above, a totally white image was made by means of an inversion development mode in the same way as in Examples 36–45. As a result, it was found that sensitivity of the photoreceptor 1*a* greatly decreased to give a poor gradient of image concentration, and a large number of dark-spotted defects were observed. In this connection, the liquid coating material for forming the under-coating layer was homogeneous enough just after the dispersion, but its viscosity was increased at the 30th day of the pot life. At the same time, however, the under-coating layer 3 yielded uneven coating, wherein the photoreceptor 1*a* was made in the same manner as in Comparative Example 20. The image generated, further, produced a large number of dark-spotted defects thereon, and the image defects caused by uneven coating were also observed. Table 4 shows these together.

TABLE 4

| Comparative Example | Totally white image at the early stage | 30 Days after the pot life | Totally white image after the pot life |
|---|---|---|---|
| 13 | X | XX | Not evaluated |
| 14 | X | ○ | X |
| 15 | X | XX | Not evaluated |
| 16 | X | ○ | X |
| 17 | X | Much viscous | X uneven coating |
| 18 | X | Much viscous | X uneven coating |
| 19 | XX | Δ | XX |
| 20 | X | Much viscous | X |

| (Totally white image at the early stage) | (30 Days after the pot life) | (Totally white image after the pot life) |
|---|---|---|
| ○: no dark-spotted defects | ○: no cohesion and deposition | ○: no dark-spotted defects |
| Δ: slightly dark-spotted defects | Δ: somewhat aggregate and deposition | Δ: slightly dark-spotted defects |
| X: many dark-spotted defects | X: much aggregate and deposition | X: many dark-spotted defects |
| XX: a great many dark-spotted defects | XX: completely deposited | XX: a great many dark-spotted defects |

From the results of Examples 36–45 and Comparative Example 13–20, it is found that treatment of the titanium oxide surface with (a) metal oxide(s) and/or (an) organic compound(s) improves the preservation stability of the liquid coating material for forming the under-coating layer to generate a better image character with no image defect. It is also found that the preferred metal oxide used in coating of the titanium oxide surface include $Al_2O_3$ and/or ZrO, $ZrO_2$. It is further found that the preferred titanium oxide is in a form of needles.

EXAMPLE 46

In the same manner as in Example 36, the under-coating layer 3 was provided, provided that the components of the liquid coating material for forming the under-coating layer used in Example 36 were altered as follows. Then, the photoreceptive layer 4 was provided in the same manner as in Example 37 to produce the electrophotographic photoreceptor 1*a* of function-separating type.

Liquid Coating Material for Forming the Under-Coating Layer

| | |
|---|---|
| Titanium oxide (needle-like; the surface treated with $Al_2O_3$; titanium oxide content 90%): STR-60 (Product of Sakai Chemical Ind. Co., Ltd.) | 3 weight parts |
| Alcohol-soluble nylon resin: CM8000 (Product of Toray Industries Inc.) | 3 weight parts |
| Methanol | 35 weight parts |
| 1,2-Dichloroethane | 65 weight parts |

EXAMPLE 47

In the same manner as in Example 36, the under-coating layer 3 was provided, provided that the components of the liquid coating material for forming the under-coating layer used in Example 36 were altered as follows. Then, the photoreceptive layer 4 was provided in the same manner as in Example 37 to produce the electrophotographic photoreceptor 1*a* of function-separating type.

Liquid Coating Material for Forming the Under-Coating Layer

| | |
|---|---|
| Titanium oxide (needle-like; the surface treated with $Al_2O_3$; titanium oxide content 90%): STR-60 (Product of Sakai Chemical Ind. Co., Ltd.) | 3 weight parts |
| Alcohol-soluble nylon resin: CM8000 (Product of Toray Industries Inc.) | 3 weight parts |
| γ-(2-Aminoethyl)aminopropylmethyldimethoxy-silane | 0.15 weight part |
| Methanol | 35 weight parts |
| 1,2-Dichloroethane | 65 weight parts |

EXAMPLES 48–51

In the same manner as in Example 36, the under-coating layer 3 was provided, provided that the silane-coupling agent of the liquid coating material for forming the under-coating layer used in Example 47 was altered to the agents and amounts as mentioned respectively in the following Examples 48–51. Then, the photoreceptive layer 4 was provided in the same manner as in Example 37 to produce the electrophotographic photoreceptor 1*a* of function-separating type.

Example 48

| | |
|---|---|
| γ-(2-Aminoethyl)aminopropylmethyldimethoxysilane (Example 49) | 0.6 weight part |
| Phenyltrichlorosilane (Example 50) | 0.15 weight part |
| Bis(dioctylpyrophosphate) (Example 51) | 0.15 weight part |
| Acetalkoxyaluminum diisopropylate | 0.15 weight part |

EXAMPLES 52 AND 53

In the same manner as in Example 46, the under-coating layer 3 was provided, provided that the adhesive resin of the liquid coating material for forming the under-coating layer used in Example 46 was altered to the resins as mentioned respectively in the following Examples 52 and 53. Then, the photoreceptive layer 4 was provided in the same manner as in Example 37 to produce the electrophotographic photoreceptor 1*a* of function-separating type.

Example 52

N-Methoxymethylated nylon resin: EF-30T (Product of Teikoku Chemical Ind. Co., Ltd.)

Example 53

Alcohol-soluble nylon resin: VM171 (Product of Daicel-Huels Ltd.)

EXAMPLE 54

In the same manner as in Example 46, the under-coating layer 3 was provided, provided that the titanium oxide of the liquid coating material for forming the under-coating layer used in Example 46 was altered to the following ones. Then, the photoreceptive layer 4 was provided in the same manner as in Example 37 to produce the electrophotographic photoreceptor 1*a*of function-separating type.

| | |
|---|---|
| Needle-like rutile-type; the surface treated with $Al_2O_3$ and $ZrO_2$ (titanium content 86%): TTO-M-1 (Product of Ishihara Sangyo Kaisha Ltd.) | 1.5 weight parts |
| Needle-like rutile-type; the surface treated with $Al_2O_3$ and $SiO_2$ (titanium content 91%): STR-60S (Product of Sakai Chemical Ind. Co., Ltd.) | 1.5 weight parts |

EXAMPLE 55

In the same manner as in Example 46, the under-coating layer 3 was provided, provided that the titanium oxide of the liquid coating material for forming the under-coating layer used in Example 46 was altered to the following ones. Then, the photoreceptive layer 4 was provided in the same manner as in Example 37 to produce the electrophotographic photoreceptor 1*a* of function-separating type.

| | |
|---|---|
| Needle-like rutile-type; the surface treated with $Al_2O_3$ and $ZrO_2$ (titanium content 88%): TTO-S-1 (Product of Ishihara Sangyo Kaisha Ltd.) | 2 weight parts |
| Surface-treated granular anatase type (titanium content 98%): TA-300 (Fuji Titanium Industry Co., Ltd.) | 1 weight part |

Using the photoreceptor 1*a* produced in Examples 46–55 as above, a totally white image was made by means of an inversion development mode in the same way as in Examples 36–45. As a result, better images with no defect were obtained in any of the photoreceptors. In addition, there was no occurrence of aggregates of titanium oxide at the 30th days of the pot life, and there was no problem in preservation stability of the liquid coating materials except that of Example 54. In Example 54, slight deposition of titanium oxide was observed. Moreover, the photoreceptors 1*a* were produced in the same way as in Examples 46–55 at the 30th day of the pot life to generate their images, which were better ones similar to those at the early stage with no defect except those of Examples 54 and 55. In Examples 54 and 55, slight dark-spotted defects occurred. Table 5 shows the results of evaluation together.

TABLE 5

| | Totally white image at the early stage | 30 Days after the pot life | Totally white image after the pot life |
|---|---|---|---|
| Example 46 | ○ | ○ | ○ |
| Example 47 | ○ | ○ | ○ |
| Example 48 | ○ | ○ | ○ |
| Example 49 | ○ | ○ | ○ |
| Example 50 | ○ | ○ | ○ |
| Example 51 | ○ | ○ | ○ |
| Example 52 | ○ | ○ | ○ |
| Example 53 | ○ | ○ | ○ |
| Example 54 | ○ | Δ | Δ |
| Example 55 | ○ | ○ | Δ |
| Com. Ex. 21 | Many fogs | × | Many fogs |

(Totally white image at the early stage) ○: no dark-spotted defects Δ: slightly dark-spotted defects ×: many dark-spotted defects
(30 Days after the pot life) ○: no aggregate and deposition Δ: slight deposition ×: much aggregate and deposition
(Totally white image after the pot life) ○: no dark-spotted defects Δ: slightly dark-spotted defects ×: many dark-spotted defects

COMPARATIVE EXAMPLE 21

In the same manner as in Example 46, the under-coating layer 3 was provided, provided that the titanium oxide of the liquid coating material for forming the under-coating layer used in Example 46 was altered to the following one. Then, the photoreceptive layer 4 was provided in the same manner as in Example 37 to produce the electrophotographic photoreceptor 1*a* of function-separating type.

| | |
|---|---|
| Titanium oxide (needle-like; the surface-treated with $SnO_2$ Sb dope; conductive treatment): FT-1000 (Ishihara Sangyo Kaisha Ltd.) | 3 weight parts |

Using the photoreceptor 1*a* produced in Comparative Example 21 as above, a totally white image was made by means of an inversion development mode in the same way as in Examples 36–45. As a result, an electrically worse charged image with many fogs was generated. In addition, at the 30th day of the pot life, aggregation and deposition occurred in the liquid coating material, and the image generated therewith had many fogs as in that of the early stage. The result is also shown in Table 5.

From the results of Examples 46–55 and Comparative Example 21, it is found that treatment of the titanium oxide surface with (a) metal oxide (s) and/or (an) organic compound(s) improves the preservation stability of the liquid coating material for forming the under-coating layer to generate a better image character with no image defect. It is also found that the preferred metal oxide used in coating of the titanium oxide surface include $Al_2O_3$ and/or ZrO, $ZrO_2$. It is also found that the titanium oxide passing through conductive treatment greatly reduces the electric charge of the photoreceptor. It is further found that the preferred titanium oxide is in a form of needles. It is further found that the use of polyamide resins as adhesive resins improves preservation stability of the liquid coating material for forming the under-coating layer and affords a better image even though the photoreceptor is produced with the liquid coating material after a long lapse of time.

EXAMPLE 56

In the same manner as in Example 36, a liquid coating material for forming the under-coating layer was prepared, wherein the components of the liquid coating material used in Example 36 were altered as follows. Then, using a dip coating apparatus as shown in FIG. 2, an aluminum cylinder of 65 mm in diameter and 348 mm in length was immersed into the liquid coating material to form a film on the cylinder surface. After drying, the under-coating layer 3 of 0.5 μm in dry thickness was obtained. Subsequently, in order to form a charge generation layer 5 and a charge transport layer 6, the cylinder was immersed into the respective solutions that had been prepared. The cylinder was then dried at 80° C. under hot air for 1 hour to yield the photoreceptive layer 4 of 27 μm in dry thickness. Thus, the electrophotographic photoreceptor 1*a* of function-separating type was produced.

Liquid Coating Material for Forming the Under-Coating Layer

| | |
|---|---|
| Needle-like rutile-type; the surface treated with $Al_2O_3$ and $ZrO_2$ (titanium content 86%): TTO-M-1 (Product of Ishihara Sangyo Kaisha Ltd.) | 1.5 weight parts |
| Alcohol-soluble nylon resin: CM8000 (Product of Toray Industries Inc.) | 3 weight parts |
| Methanol | 35 weight parts |
| 1,2-Dichloroethane | 65 weight parts |

EXAMPLES 57–59

In the same manner as in Example 56, the under-coating layer 3 was provided, provided that the film prepared with the liquid coating material for forming the under-coating layer used in Example 56 was fixed to 1, 5 or 10 μm in dry thickness. Then, the photoreceptive layer 4 was provided in the same manner as in Example 56 to produce the electrophotographic photoreceptor 1*a* of function-separating type.

| | | |
|---|---|---|
| (Example 57) | Thickness of the under-coating layer 3 | 1 μm |
| (Example 58) | Thickness of the under-coating layer 3 | 5 μm |
| (Example 59) | Thickness of the under-coating layer 3 | 10 μm |

The respective photoreceptors 1*a* produced in Examples 56–59 as above were installed in a digital copying machine AR-5030 (Sharp Co., Ltd.), and the totally white image was made by means of an inversion development mode. As a result, there was no defective image in any cases of Examples 56–59 yielding better images.

COMPARATIVE EXAMPLES 22 AND 23

In the same manner as in Example 56, the under-coating layer 3 was provided, provided that the coat prepared with the liquid coating material for forming the under-coating layer used in Example 56 was fixed to 0.01 μm and 15 μm in dry thickness. The photoreceptive layer 4 was then provided in the same manner as in Example 56 to produce the electrophotographic photoreceptor 1*a* of function-separating type.

| | | |
|---|---|---|
| (Comparative Example 22) | Thickness of the under-coating layer 3 | 0.01 μm |
| (Comparative Example 23) | Thickness of the under-coating layer 3 | 15 μm |

The respective photoreceptors 1*a* produced in Comparative Examples 22 and 23 as above were installed in a digital copying machine AR-5030 (Sharp Co., Ltd.), and the totally white image was made by means of an inversion development mode. As a result, there was no defective image in Comparative Examples 22 and 23 yielding better images.

Moreover, a copying durability test was carried out on 30,000 sheets under an environment at a low temperature of 10° C. and low humidity of 15% RH as to the receptor 1*a* produced in Examples 56–59 and Comparative Examples 22 and 23. The result is shown in Table 6.

TABLE 6

| | Under-coating layer thickness | Initial Potential in dark $V_0$ (−V) | Initial Potential in light $V_L$ (−V) | Initial Image | After 30,000 Sheet copying Potential in dark $V_0$ (−V) | After 30,000 Sheet copying Potential in light $V_L$ (−V) | After 30,000 Sheet copying Image |
|---|---|---|---|---|---|---|---|
| Ex. 56 | 0.05 | 600 | 100 | ○ | 600 | 115 | ○ |
| Ex. 57 | 1.0 | 610 | 110 | ○ | 590 | 130 | ○ |
| Ex. 58 | 5 | 630 | 130 | ○ | 600 | 170 | ○ |
| Ex. 59 | 10 | 645 | 140 | ○ | 610 | 180 | ○ |
| C. Ex. 22 | 0.01 | 590 | 100 | ○ | 605 | 100 | XX |
| C. Ex. 23 | 15 | 660 | 200 | ○ | 610 | 320 | Sensitivity lowered |

(Image)
○: no dark-spotted defects;
Δ: slightly dark-spotted defects;
X: many dark-spotted defects;
XX: a great many dark-spotted defects From Table 6, it is found that, when the thickness of the under-coating layer 3 is in a range of 0.05 μm–10 μm, stable sensitivity is obtained. The image characters examined after a copying durability test on 30,000 sheets afforded very good images as in the initial ones in Examples 56–59. On the other hand, a great many dark-spotted defects occurred on the image after the copying durability test in Comparative Example 22, and the sensitivity greatly decreased in Comparative Example 23.

EXAMPLES 60–63

In the same manner as in Example 56, the under-coating layer 3 was provided using the liquid coating material for forming the under-coating layer as used in Example 56, provided that the ratio of titanium oxide (P) to polyamide resin (R) was fixed to 10/90, 35/65, 70/30 and 99/1 in Examples 60–63, respectively. Then, the photoreceptive layer 4 was provided in the same manner as in Example 56 to produce the electrophotographic photoreceptor 1*a* of function-separating type.

Example 60

P/R=10/90

Example 61

P/R=35/65

Example 62

P/R=70/30

Example 63

P/R=99/1

The respective photoreceptors 1*a* produced as above were installed in a digital copying machine AR-5030 (Sharp Co., Ltd.), and totally white images were made by means of an inversion development mode. As a result, there was no defective image in Examples 60–63 yielding better images. Moreover, a copying durability test was carried out on 30,000 sheets under an environment at a low temperature of 10° C. and low humidity of 15% RH. The result is shown in Table 7.

TABLE 7

| | Under-coating layer P/R | Initial Potential in dark $V_0$ (−V) | Initial Potential in light $V_L$ (−V) | Initial Image | After 30,000 Sheet copying Potential in dark $V_0$ (−V) | After 30,000 Sheet copying Potential in light $V_L$ (−V) | After 30,000 Sheet copying Image |
|---|---|---|---|---|---|---|---|
| Ex. 60 | 10/90 | 630 | 120 | ○ | 600 | 160 | ○ |
| Ex. 61 | 35/65 | 620 | 110 | ○ | 590 | 130 | ○ |
| Ex. 62 | 70/30 | 610 | 110 | ○ | 600 | 120 | ○ |
| Ex. 63 | 99/1 | 590 | 100 | ○ | 610 | 110 | Δ |

(Image)
○: no dark-spotted defects;
Δ: slightly dark-spotted defects;
X: many dark-spotted defects From Table 7, it is found that, when the titanium oxide content of the under-coating layer is in a range of 10% by weight–99% by weight, stable sensitivity is obtained. The image characters examined after a copying durability test on 30,000 sheets afforded very good images as the initial ones in Examples 60–62. On the other hand, somewhat dark-spotted defects occurred on the image after the copying durability test in Example 63.

EXAMPLES 64–69

In the same manner as in Example 56, the under-coating layer 3 was provided using the liquid coating material for forming the under-coating layer as used in Example 56, provided that the components of the organic solvents used were fixed respectively as shown below in Examples 64–69. Then, the photoreceptive layer 4 was provided in the same manner as in Example 56 to produce the electrophotographic photoreceptor la of function-separating type. The figures corresponding to the respective solvents are indicated by weight part.

Example 64

Methyl alcohol/1,2-dichloropropane=43.46/38.54

Example 65

Methyl alcohol/chloroform=10.33/71.67

Example 66

Methyl alcohol/tetrahydrofuran=25.50/56.50

Example 67

Methyl alcohol/toluene=58.30/23.70

Example 68

Ethyl alcohol/chloroform=30/52

Example 69

Ethyl alcohol/dichloromethane=70/12

The photoreceptors 1*a* produced in Examples 64–69 as above were visually examined as to whether there was any uneven coating in either case in which the under-coating layer 3 alone was formed or the photoreceptive layer 4 was also formed. As a result, no uneven coating was observed in any solvents used. In addition, a better image character with no image defect was obtained. Moreover, in the similar coating film formed and examined at the 30th day of the pot life, a good film character and image character similar to the initial ones were obtained.

COMPARATIVE EXAMPLE 24

In the same manner as in Example 56, the under-coating layer 3 was provided using the liquid coating material for forming the under-coating layer as used in Example 56, provided that methanol was used as an organic solvent in an amount of 82 weight parts. Then, the photoreceptive layer 4 was provided in the same manner as in Example 56 to produce the electrophotographic photoreceptor 1*a* of function-separating type.

The photoreceptor 1*a* produced in Comparative Example 24 as above was visually examined as to whether there was any uneven coating in either case in which the under-coating layer 3 alone was formed or the photoreceptive layer 4 was also formed. In coating the under-coating layer, falling in drops was observed and a rough-grained and uneven image was generated. Moreover, a coating film was made after a lapse of 30 days of the pot life in the same manner as in Comparative Example 24 and the image character was examined. As a result, the falling in drops in the under-coating layer grew larger and rough dark-spotted defects occurred.

EXAMPLE 70

In the same manner as in Example 36, the under-coating layer 3 was provided, provided that the components of the liquid coating material for forming the under-coating layer used in Example 36 were altered as follows. The photoreceptive layer 4 was then provided in the same manner as in Example 37 to produce the electrophotographic photoreceptor 1*a* of function-separating type.

Liquid Coating Material for Forming the Under-Coating Layer

| | |
|---|---|
| Titanium oxide (needle-like; the surface treated with $Al_2O_3$; titanium oxide content 90%): 0.05 μm × 0.01 μm; aspect ratio 5; STR-60 (Product of Sakai Chemical Ind. Co., Ltd.) | 3 weight parts |
| Alcohol-soluble nylon resin: CM8000 (Product of Toray Industries Inc.) | 3 weight parts |
| γ-(2-Aminoethyl)aminopropyltrimethoxysilane | 0.15 weight part |
| Methanol | 35 weight parts |
| 1,2-Dichloroethane | 65 weight parts |

EXAMPLE 71

In the same manner as in Example 36, the under-coating layer 3 was provided, provided that the components of the liquid coating material for forming the under-coating layer used in Example 36 were altered as follows. The photoreceptive layer 4 was then provided in the same manner as in Example 37 to produce the electrophotographic photoreceptor 1*a* of function-separating type.

Liquid Coating Material for Forming the Under-Coating Layer

| | |
|---|---|
| Titanium oxide (needle-like; the surface treated with Al laurate; titanium oxide content 83%): 0.02 μm × 0.01 μm; aspect ratio 2; MT-100S (Product of Teika Co., Ltd.) | 3 weight parts |
| Alcohol-soluble nylon resin: CM8000 (Product of Toray Industries Inc.) | 3 weight parts |
| N-Phenyl-γ-aminopropyltrimethoxysilane | 0.15 weight part |
| Methanol | 35 weight parts |
| 1,2-Dichloroethane | 65 weight parts |

EXAMPLE 72

In the same manner as in Example 36, the under-coating layer 3 was provided, provided that the components of the liquid coating material for forming the under-coating layer used in Example 36 were altered as follows. The photoreceptive layer 4 was then provided in the same manner as in Example 37 to produce the electrophotographic photoreceptor 1*a* of function-separating type.

Liquid Coating Material for Forming the Under-Coating Layer

| | |
|---|---|
| Titanium oxide (needle-like; the surface untreated; titanium oxide content 83%): 3 – 6 μm × 0.05 – 0.1 μm; aspect ratio 30 – 120; FTL-100 (Product of Ishihara Sangyo Kaisha Ltd.) | 3 weight parts |
| Alcohol-soluble nylon resin: CM8000 (Product of Toray Industries Inc.) | 3 weight parts |
| γ-Chloropropyltrimethoxysilane | 0.15 weight part |
| Methanol | 35 weight parts |
| 1,2-Dichloroethane | 65 weight parts |

Using the photoreceptor 1*a* produced in Examples 70–72 as above, a totally white image was made by means of an inversion development mode in the same way as in Examples 36–45. As a result, better images with no defect were obtained in any of the photoreceptors. In addition, there was no occurrence of aggregates of titanium oxide at the 30th days of the pot life, and there was no problem in preservation stability of the liquid coating materials. Moreover, the photoreceptors 1*a* were produced in the same way as in Examples 70–72 at the 30th day of the pot life to generate their images. The resulting images were satisfactory and similar to those at the early stage with no defect.

From Examples 36–72 as mentioned above, the surface coating of the needle-like titanium oxide particles with (a) metal oxide(s) and/or (an) organic compound(s) affords a well dispersible liquid coating material for forming the under-coating layer highly stable during preservation. When the photoreceptor containing such titanium oxide is installed in an image-forming apparatus for inversion development processing, a very satisfactory image character can be obtained because an injection of the charge from the conductive support 2 is inhibited. Such titanium oxide is well adaptable to adhesive resins to reduce cohesion among the titanium oxide particles. By using a mixture of a lower alcohol and another organic solvent or their azeotropic mixture, used in the liquid coating material for forming the under-coating layer, a more stable dispersibility of the liquid coating material can be obtained, and the stability is retained over a long period of time. Thus prepared liquid coating material enables formation of the uniform under-coating layer 3 which generates a better image character. Since the needle-like titanium oxide particles are used, electrophotographic photoreceptors 1*a* and 1*b* which have a satisfactory environmental characteristic, which do not cause deterioration of electric and image characteristics due to repeated use over a long term, and which have a very stable character can be obtained. Moreover, since the liquid coating material for forming the under-coating layer is highly dispersible and stable, the uniform under-coating layer 3 can be formed on the conductive support 2 by means of an immersion-coating method. Thus, highly sensitive and long-lived electrophotographic photoreceptors 1*a* and 1*b*, a method for producing the same, and an image-forming apparatus using the same can be provided.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor for use in an image forming apparatus for forming an image by an inversion development process comprising:

a conductive support;

an under-coating layer provided on the conductive support; and a photosensitive layer provided on the under-coating layer, wherein the under-coating layer contains dendritic titanium oxide and wherein the photoreceptive layer contains a phthalocyanine pigment.

2. The electrophotographic photoreceptor of claim 1, wherein a surface of the titanium oxide is coated with a metal oxide or oxides and/or an organic compound or compounds.

3. The electrophotographic photoreceptor of claim 1, wherein the under-coating layer contains an alcohol-soluble polyamide resin in addition to the dendritic titanium oxide of which the surface is coated with (a) metal oxide(s) and/or (an) organic compound(s).

4. The electrophotographic photoreceptor of claim 1, wherein the photoreceptive layer has a charge generation layer and a charge transport layer, wherein the charge generation layer contains a phthalocyanine pigment.

5. An electrophotographic photoreceptor for use in an image forming apparatus for forming an image by an inversion development process comprising:

a conductive support;

an under-coating layer formed on the conductive support; and a photoreceptive layer formed on the under-coating layer, wherein the under-coating layer contains needle-like titanium oxide whose surface is coated with (a) metal oxide(s) and/or a silane coupling agent devoid of unsaturated bonds, and the above photoreceptive layer contains a phthalocyanine pigment.

6. The electrophotographic photoreceptor of claim 5, wherein the under-coating layer contains an alcohol-soluble polyamide resin in addition to the needle-like titanium oxide of which the surface is coated with (a) metal oxide(s) and/or (an) organic compound(s).

7. The electrophotographic photoreceptor of claim 5, wherein the photoreceptive layer has a charge generation layer and a charge transport layer, and the charge generation layer contains a phthalocyanine pigment.

8. The electrophotographic photoreceptor of claim 1, wherein the titanium oxide is selected from those of 1 $\mu$m or less in the short axis and 100 $\mu$m or less in the long axis.

9. The electrophotographic photoreceptor of claim 5, wherein the needle-like titanium oxide is selected from those of which the average aspect ratio is in a range of from 1.5 to 300.

10. The electrophotographic photoreceptor of claim 1, wherein titanium oxide which is not subjected to a conductive processing is used.

11. The electrophotographic photoreceptor of claim 1, wherein the under-coating layer contains titanium oxide in a range of from 10% by weight to 99% by weight.

12. A method for producing an electrophotographic photoreceptor for use in an image forming apparatus for forming an image by an inversion development process, comprising the steps of:

applying a liquid coating material for forming an under-coating layer to a conductive support to form an under-coating layer on the conductive support; and forming a photoreceptive layer containing a phthalocyanine pigment on the under-coating layer, wherein the liquid coating material for forming the under-coating layer comprises dendritic titanium oxide whose surface is coated with (a) metal oxide(s) and/or a silane coupling agent devoid of unsaturated bonds, a polyamide resin soluble in organic solvents, and an organic solvent, and the organic solvent is a mixture of a solvent selected from the group consisting of lower alcohols of 1–4 carbon atoms with a solvent selected from the group consisting of dichloromethane, chloroform, 1,2-dichloroethane, 1-,2-dichloropropane, toluene and tetrahydrofuran.

13. A method for producing an electrophotographic photoreceptor for use in an image forming apparatus for forming an image by an inversion development process, comprising the steps of:

applying a liquid coating material for forming an under-coating layer to a conductive support to form an under-coating layer on the conductive support; and forming a photoreceptive layer containing a phthalocyanine pigment on the under-coating layer, wherein the liquid coating material for forming the under-coating layer comprises needle-like titanium oxide of which the surface is coated with (a) metal oxide(s) and/or a silane coupling agent devoid of unsaturated bonds, a polyamide resin soluble in organic solvents, and an organic solvent, and the organic solvent is a mixture of a solvent selected from the group consisting of lower alcohols of 1–4 carbon atoms with a solvent selected from the group consisting of dichloromethane, chloroform, 1,2-dichloroethane, 1,2-dichloropropane, toluene and tetrahydrofuran.

14. The electrophotographic photoreceptor of claim 5, wherein the titanium oxide is selected from those of 1 $\mu$m or less in the short axis and 100 $\mu$m or less in the long axis.

15. The electrophotographic photoreceptor of claim 5, wherein titanium oxide which is not subjected to a conductive processing is used.

16. The electrophotographic photoreceptor of claim 5, wherein the under-coating layer contains titanium oxide in a range of from 10% by weight to 99% by weight.

* * * * *